US011077448B2

(12) United States Patent
Ragnarsson

(10) Patent No.: US 11,077,448 B2
(45) Date of Patent: Aug. 3, 2021

(54) PORTABLE GRINDING/SHREDDING/CHIPPING SYSTEM HAVING MANIPULABLE TRACK DRIVE AND OTHER IMPROVEMENTS

(71) Applicant: RAGNAR ORIGINAL INNOVATION, INC., Hooksett, NH (US)

(72) Inventor: Anders Ragnarsson, Chester, NH (US)

(73) Assignee: TIGERCAT INDUSTRIES INC., Brantford (CA)

( * ) Notice: Subject to any disclaimer, the term of this patent is extended or adjusted under 35 U.S.C. 154(b) by 161 days.

(21) Appl. No.: 16/398,733

(22) Filed: Apr. 30, 2019

(65) Prior Publication Data

US 2019/0336980 A1 Nov. 7, 2019

Related U.S. Application Data

(60) Provisional application No. 62/665,166, filed on May 1, 2018.

(51) Int. Cl.

| | |
|---|---|
| ***B02C 21/02*** | (2006.01) |
| ***B02C 23/04*** | (2006.01) |
| ***B02C 23/02*** | (2006.01) |

(52) U.S. Cl.

CPC ..... *B02C 21/02* (2013.01); *B02C 23/02* (2013.01); *B02C 23/04* (2013.01)

(58) Field of Classification Search

CPC ..... B02C 21/026; B02C 21/02; B02C 23/04; B02C 25/00; B02C 4/34; B62D 55/116; B62D 55/062

See application file for complete search history.

(56) References Cited

U.S. PATENT DOCUMENTS 3,190,571 A * 6/1965 Kimball ..... B02C 4/42 241/230

3,752,409 A 8/1973 Lewis (Continued)

OTHER PUBLICATIONS

Written Opinion filed in corresponding PCT Application No. PCT/US2019/029852 dated Jul. 10, 2019.

(Continued)

*Primary Examiner* — Adam J Eiseman
*Assistant Examiner* — P Derek Pressley
(74) *Attorney, Agent, or Firm* — Finch & Maloney, PCCL; Michael J. Bujold; Ross K. Krutsinger

(57) ABSTRACT

A portable grinding/shredding/chipping system with a drive track assembly which is manipulatable to facilitate altering the orientation of the portable grinding/shredding/chipping system. This arrangement results in improved loading and processing, of both long and short materials, as well as facilitates connection of a transport dolly and a transport truck/tractor without requiring any additional lifting mechanism. A pivotable housing provides greater access to the rotor and has an over-center arrangement which prevents the pivotable housing from inadvertently moving or pivoting back into engagement with the rotor. The portable grinding/shredding/chipping system is provided with a belt drive assembly which facilitates modification of the rotational speed of the rotor by merely replacing a sheave of the belt drive assembly. Lastly, both head and tail pulleys are driven by a respective motor so that a catinary of the discharge conveyor is radiussed which shortens an axial length of the system.

15 Claims, 20 Drawing Sheets

(56) References Cited

U.S. PATENT DOCUMENTS

| | | | | |
|---|---|---|---|---|
| 3,811,708 | A * | 5/1974 | Baaso | B62D 53/0842 280/433 |
| 2001/0020656 | A1* | 9/2001 | Frick | B02C 21/02 241/101.74 |
| 2003/0062434 | A1* | 4/2003 | Moriya | B02C 13/095 241/101.74 |
| 2003/0141394 | A1* | 7/2003 | Ueda | B02C 18/2241 241/73 |
| 2005/0194478 | A1* | 9/2005 | Tanaka | B02C 23/16 241/28 |
| 2007/0205313 | A1* | 9/2007 | Yagura | B02C 21/026 241/36 |
| 2008/0174097 | A1* | 7/2008 | Kaethner | E02F 9/2257 280/782 |
| 2009/0224087 | A1* | 9/2009 | Ragnarsson | B02C 13/06 241/34 |
| 2010/0252670 | A1* | 10/2010 | Kitaguchi | B02C 18/145 241/277 |

OTHER PUBLICATIONS

International Search Report filed in corresponding PCT Application No. PCT/US2019/029852 dated Jul. 10, 2019.

* cited by examiner

STAGE 2 - ATTACHING TRUCK AFTER DOLLY HAS BEEN SUCCESSFULLY CONNECTED

STAGE 2 - ATTACHING TRUCK AFTER DOLLY HAS BEEN SUCCESSFULLY CONNECTED

TRANSPORT MODE WHEN USING DOLLY

PORTABLE GRINDING/SHREDDING/CHIPPING SYSTEM HAVING MANIPULABLE TRACK DRIVE AND OTHER IMPROVEMENTS

FIELD OF THE INVENTION

The present invention relates to a portable grinding/shredding/chipping system with a drive track assembly which is manipulatable to facilitate altering the orientation, eg., horizontal, incline or decline, of the portable grinding/shredding/chipping system as well as facilitate loading and unloading of the portable grinding/shredding/chipping system for transportation thereof. In addition, the portable grinding/shredding/chipping system is provided with an improved pivotable housing which provides greater access to the rotor, during maintenance and servicing thereof, while also positioning the pivotable housing at a location in which its center of gravity constantly maintains the pivotable housing in a servicing orientation thereby preventing the pivotable housing from inadvertently moving or pivoting back toward the rotor. Lastly, the portable grinding/shredding/chipping system is designed to have a drive assembly that can be readily modified so that the rotor can rotate in either a clockwise (downswing) rotational direction (by adding an intermediate shaft with a gear, connected to a gear on the rotor shaft to achieve an additional approximately 3:1 reduction of the rotor speed) or a counter clockwise (upswing) rotational direction (without any intermediate shaft) and provide modification of the rotational speed of the rotor by merely changing a drive belt and a sheave of the drive assembly, for example, thereby providing greater versatility for the portable grinding/shredding/chipping system.

BACKGROUND OF THE INVENTION

Prior art comminuting apparatuses and devices reduce large diameter wood products and stumps, for example, to a desired particle size and typically comprise a reduction chamber which has an impact rotor located concentrically therein, in combination with a surrounding housing, a drive motor driving the rotor and an infeed chute for supplying material to be reduced. The rotor has a plurality of impact strikers secured to its exterior surface. The rotor is positioned so that the log, tree, debris, wood product, stump, etc., to be comminuted, is fed into the reduction chamber and directed against the strikers, and repelled in the rotor's rotational direction against an anvil which is located along either the top or the bottom of the reduction chamber, depending upon the rotational direction of the rotor.

The drive arrangements of prior art comminuting apparatuses and devices that have a rotor which rotates in a clockwise (downswing) rotational direction typically have a different design and configuration then those which have a rotor which rotates in a counter clockwise (upswing) rotational direction, thereby increasing the overall manufacturing cost of such prior art comminuting apparatuses and devices.

In addition, when servicing of the prior art comminuting apparatuses and devices is required, e.g., servicing the rotor, the feed roller typically does not move sufficiently out of the way of the service personnel and thus interferes with maintenance or servicing of prior art comminuting apparatuses and devices.

Further, such prior art comminuting apparatuses and devices, rotating clockwise or in a downswing direction, are not typically able to rotate at sufficiently slow enough rotational speed, e.g., 200 RPM, in order to generate larger chips, e.g., 4 inches in size, which is desired for some applications; operate, as a shrewder for contaminated waste, with a slow enough rotational speed so that the anvil can swing out of the way without damaging the rotor or the anvil in the event of tramp metal is comminuted; rotate at a sufficiently fast enough rotational speed, e.g., 600-800 RPM, in order to generate smaller chips, e.g., 1 inch in size, which is desired for some other applications; or rotate in a counter clockwise (upswing) rotational direction with the rotor having a rotational speed of between 1,000 to 1,500 RPM,

SUMMARY OF THE INVENTION

Wherefore, it is an object of the disclosure to overcome the above-mentioned shortcomings and drawbacks associated with the prior art portable grinding/shredding/chipping systems.

Another object of the disclosure is to improve both loading and processing, of long and short length materials, as well as facilitate connection of a transport dolly and a transport truck/tractor to the portable grinding/shredding/chipping system, without requiring any an additional lifting mechanism or equipment.

Yet another object of the disclosure is to provide a portable grinding/shredding/chipping system with a drive track assembly with one end thereof which is readily movable, relative to a remainder of the portable grinding/shredding/chipping system, in order to assist with changing the orientation of the portable grinding/shredding/chipping system, relative to the ground or some other support surface, to assist with feeding the debris into the portable grinding/shredding/chipping system, as well as to facilitate loading/unloading of the portable grinding/shredding/chipping system, when transporting the portable grinding/shredding/chipping system from jobsite to jobsite, by using either a common machine (lowboy) trailer or a dolly and a truck/tractor arrangement.

A further object of the disclosure is to provide a portable grinding/shredding/chipping system which can be manufactured so as to be slightly taller, e.g., by a few inches or so, due to the manipulatable/movable drive track assembly, relative to a remainder of the portable grinding/shredding/chipping system, and thereby permit the portable grinding/shredding/chipping system to have a shorter overall axial length and be somewhat lighter in weight.

Still another object of the disclosure is to provide an improved pivotable housing which provides greater access to the rotor, during maintenance and servicing thereof, while also facilitates positioning the pivotable housing into a generally vertical orientation such that the center of gravity of the pivotable housing maintains the pivotable housing in an over center vertical orientation which prevents the pivotable housing from inadvertently moving or pivoting back into engagement with the rotor, e.g., in the event that there is a hydraulic failure or failure of a mechanical lock device of the portable grinding/shredding/chipping system.

Yet another object of the disclosure, is to provide a drive arrangement, for the downswing version of the portable grinding/shredding/chipping system, which is readily and easily modifiable so as to allow an operator/manufacture to alter the rotational speed of the rotor by merely replacing a sheave and an associated mating drive belt of the drive arrangement, for example, with another either larger or smaller diameter sheave and corresponding longer or shorter drive belt so that the rotor rotates at a desired rotational speed, e.g., typically anywhere between 200 and 800 RPM (or possibly slower or faster), depending upon the particular application and the diameter of the installed sheave(s).

BRIEF DESCRIPTION OF THE DRAWINGS

The accompanying drawings, which are incorporated in and constitute a part of the specification, illustrate various embodiments of the invention and together with the general description of the invention given above and the detailed description of the drawings given below, serve to explain the principles of the invention. The invention will now be described, by way of example, with reference to the accompanying drawings in which.

Figure 1:
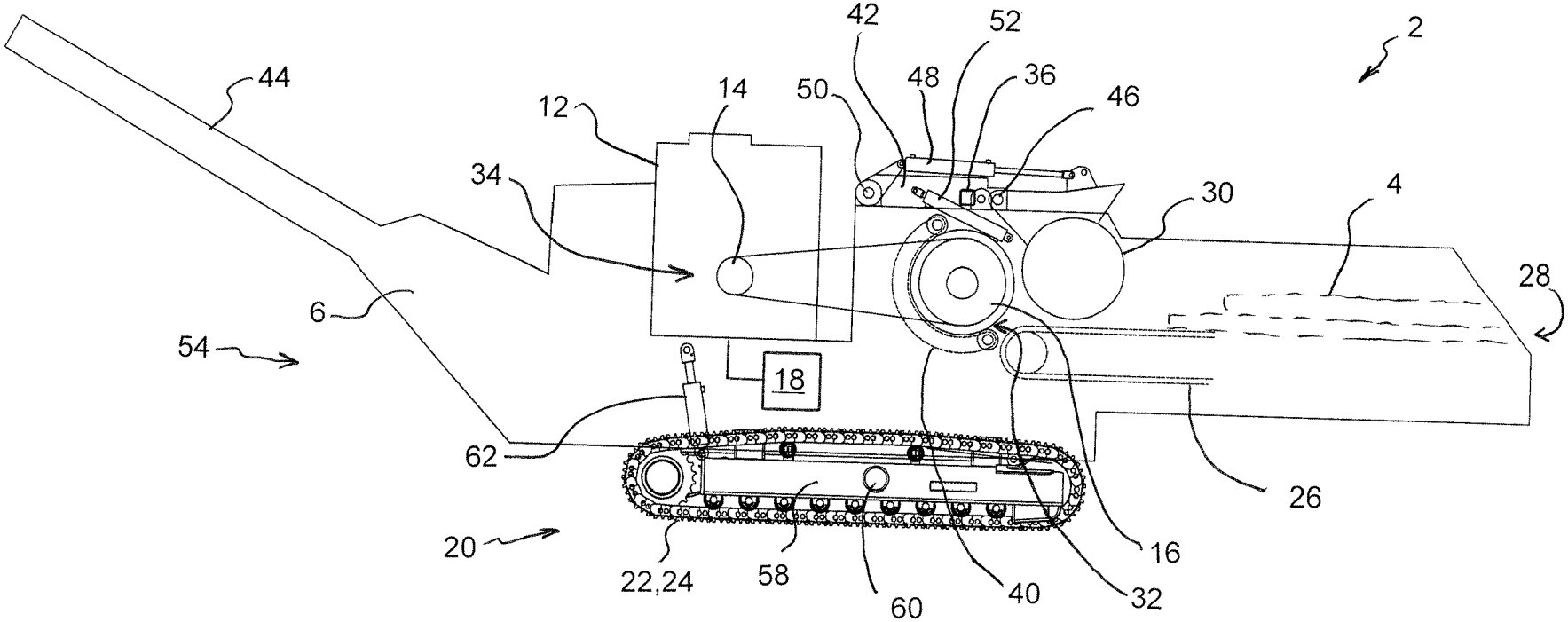
FIG. 1 is a diagrammatic right side elevational view of the portable grinding/shredding/chipping system, according to the disclosure, diagrammatically showing the improved pivotable housing in its normal in-use position, covering the rotor and closing the grinding/shredding/chipping chamber, with the feeding roller located for conveying to feed material thereto for comminution.

It should be understood that the drawings are not necessarily to scale and that the disclosed embodiments are sometimes illustrated diagrammatical and in partial views. In certain instances, details which are not necessary for an understanding of this disclosure or which render other details difficult to perceive may have been omitted. It should be understood, of course, that this disclosure is not limited to the particular embodiments illustrated herein.

DETAILED DESCRIPTION OF THE PREFERRED EMBODIMENTS

The present invention will be understood by reference to the following detailed description, which should be read in conjunction with the appended drawings. It is to be appreciated that the following detailed description of various embodiments is by way of example only and is not meant to limit, in any way, the scope of the present disclosure.

In the drawings, the term "leading (feed) end" 28 of the portable grinding/shredding/chipping system 2 is to be understood as being toward the right hand side of the respective drawing where the feed material 4 (only diagrammatically shown) is feed into the portable grinding/shredding/chipping system 2, while the term "trailing (discharge) end" 54 of the portable grinding/shredding/chipping system 2 is to be understood as being toward the left hand side of the respective drawing where the comminuted material is discharge from the portable grinding/shredding/chipping system 2 via the discharge conveyer 44.

Turning first to FIG. 1, a brief description concerning the various components of the portable grinding/shredding/chipping system 2 will now be briefly discussed. As can be seen in this first embodiment, the present invention relates to a self propelled portable grinding/shredding/chipping system 2 which can be easily and readily transported to a desired location or site in order to facilitate comminution of desired feed material 4, e.g., all types of material such forestry debris, vegetative debris, trees, bark, etc. The portable grinding/shredding/chipping system 2 comprises a base frame 6 upon which the various components of the portable grinding/shredding/chipping system 2 are assembled.

An engine 12, e.g., a diesel powered engine, is supported on the base frame 6, in a conventional manner, typically adjacent a middle section of the portable grinding/shredding/chipping system 2. An output shaft of the engine 12 drives an engine sheave 14 which, in turn, is coupled, in a conventional manner, to a conventional grinding/shredding/chipping rotor 16 (only diagrammatically shown). An output shaft of the engine 12 also drives a hydraulic pump (not shown in detail) which pumps hydraulic fluid and thus generates a source of hydraulic pressure 18 for controlling various other operations of the portable grinding/shredding/chipping system 2, as will be discussed below in further detail.

As shown, a drive track assembly 20 is connected to a bottom surface of the base frame 6 of the portable grinding/shredding/chipping system 2. The drive track assembly comprises first and second spaced apart separate frameworks 58 which each support an independently drivable track 22 or 24. Each one of the first and second tracks 22, 24 is supported on the respective framework 58 by a set of conventional sprockets, or some other conventional rotatable components (not shown in detail), which facilitate rotation and drive of the respective track 22 or 24 relative to the respective framework 58 and a remainder of the portable grinding/shredding/chipping system 2. At least one of the sprockets, of each of the first and second tracks 22, 24, is coupled to the source of hydraulic pressure 18 to facilitate supplying hydraulic pressure thereto and rotationally driving that sprocket as well as the associated track 22 or 24.

As a result of this arrangement, each of the first and second tracks 22, 24 can be independently driven in either a forward or a reverse driving direction as well as at a variety of different rotational speeds to facilitate movement and repositioning of the portable grinding/shredding/chipping system 2. As such independently drivable tracks 22, 24 are conventional and well known in the art, a further discussion concerning such independently drivable tracks 22, 24 is not provided.

As generally shown, the portable grinding/shredding/chipping system 2 comprises a feed conveyor 26 (only partially shown), located adjacent the leading (feed) end 28 which assists with feeding the desired feed material 4 toward the rotor 16 of the portable grinding/shredding/chipping system 2 for comminutation of the feed material 4. As such feed conveyor 26 is conventional and well known in the art, a further detailed description concerning the same is not provided.

In addition, a feed roller 30 is provided adjacent a trailing end of the feed conveyor 26 to assist with feeding the desired feed material 4 into the grinding/shredding/chipping chamber 32. As conventional in the art, the driven feed roller 30 is normally hydraulically biased toward a trailing end of the feed conveyor 26 so as to convey, along with the feed conveyor 26, the desired feed material 4 into the grinding/shredding/chipping chamber 32 for comminution. As such feed roller 30 is conventional and well known in the art, a further detailed description concerning the same is not provided.

As diagrammatically shown, a conventional rotor drive arrangement 34, such as a drive belt (e.g., either a V-belt or a cog belt), a sheave, sprocket, etc., couples the engine 12 to the rotor 16 to facilitate rotation of the rotor 16. It is to be appreciated that the engine 12 may drive the rotor 16 in either a clockwise (downswing) or a counter clockwise (upswing) rotational direction, depending upon the particular application and configuration of the portable grinding/shredding/chipping system 2. As diagrammatically shown this FIG. 1, both the engine 12 and the rotor 16 are driven in a counter clockwise (upswing) rotational direction and an anvil 36 is positioned above the rotational axis of the rotor 16, adjacent an inlet of the grinding/shredding/chipping chamber 32.

As is conventional in the art, the rotor 16 is accommodated within grinding/shredding/chipping chamber 32 (only diagrammatically shown) which comprises both a fixed or stationary housing 40 as well as a pivotable housing 42. The area located between the exterior surface of the rotor 16 and the inwardly facing surface of the fixed housing 40 and the pivotable housing 42 defines the grinding/shredding/chipping chamber 32. The material, comminuted by the rotor 16 within the grinding/shredding/chipping chamber 32, will eventually pass through the openings (not shown in detail) provided in the fixed housing 40, and are then deposited on a discharge conveyor 44 (only diagrammatically shown) for discharge from portable grinding/shredding/chipping system 2. The pivotable housing 42, on the other hand, is not provided with any openings through which any communitated material can pass. As will be described below in further detail, the pivotable housing 42 is pivotable away from the rotor 16 in order to provide access to the rotor 16 and facilitate servicing thereof, replacement of the strikers, replacement of the mounting projections, etc., as is necessary or required.

As diagrammatically shown, the discharge conveyor 44 generally collects the comminuted material from the grinding/shredding/chipping chamber 32 and conveys such comminuted material along the length of the discharge conveyor 44 where such comminuted material is discharged. The comminuted material typically falls and collects on the ground for subsequent handling or may deposited into a dump body of a dump truck, for example.

Figure 1A:
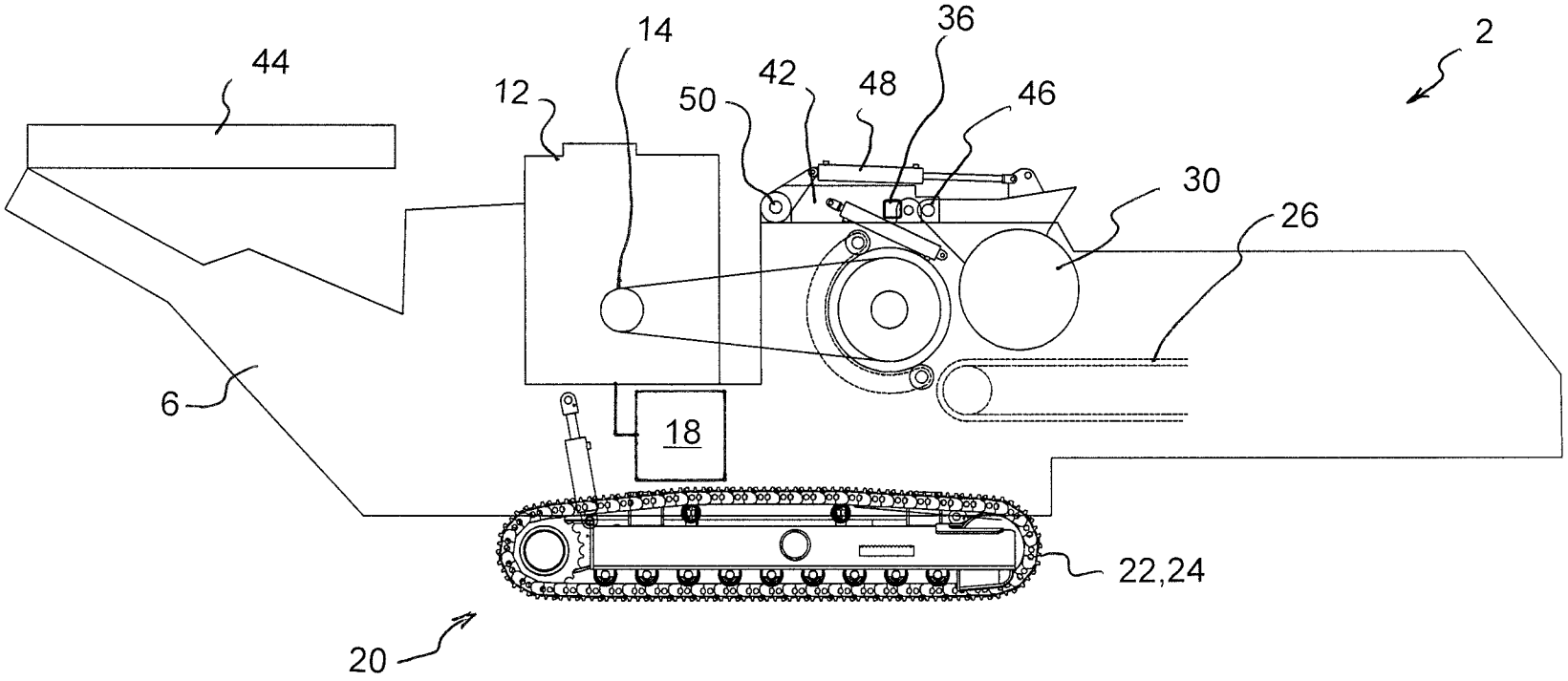
FIG. 1A is a diagrammatic right side elevational view of the portable grinding/shredding/chipping system, similar to FIG. 1, which is equipped with a folding type discharge conveyor.

Alternatively, as diagrammatically shown in FIG. 1A, the discharge conveyor 44 may be a folding type discharge conveyor 44, e.g., a middle section of the discharge conveyor 44 is provided with a hinge (not shown in detail). During transportation, the hinge permits the trailing section of the discharge conveyor 44 to fold over toward the leading section of the discharge conveyor 44 and a remainder of the portable grinding/shredding/chipping system 2, as shown, and thereby reduces the overall height of the portable grinding/shredding/chipping system 2. As such folding discharge conveyors are conventional and well known in the art, a further detail description concerning the same is not provided.

The driven feed roller 30 is supported by the pivotable housing 42 and is pivotable relative thereto about a roller pivot 46. A feed roller hydraulic cylinder 48 couples the driven feed roller 30 to the pivotable housing 42. When hydraulic fluid is supplied, via the source of hydraulic pressure 18, to a first side of the piston (not shown) accommodated within the feed roller hydraulic cylinder 48 so that the length of the feed roller hydraulic cylinder 48 is increased, such an increase in the length of the feed roller hydraulic cylinder 48 causes the driven feed roller 30 to pivot about the roller pivot 46 into its operative position, as generally shown in FIG. 1, to assist with sandwiching the feed material 4, between the driven feed roller 30 and the feed conveyor 26, and conveying of the feed material 4 into the grinding/shredding/chipping chamber 32 for comminution.

Figure 2:
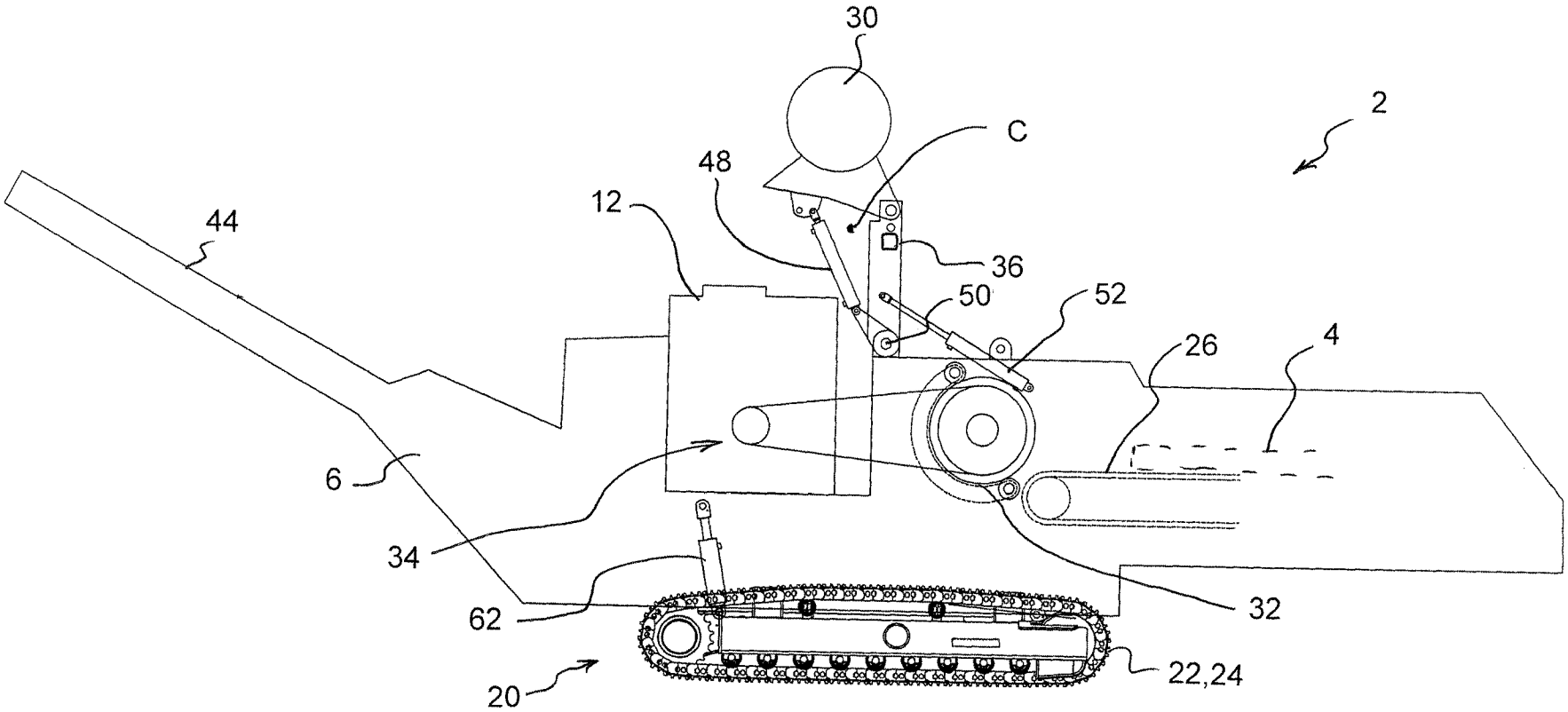
FIG. 2 is a diagrammatic right side elevational view of the portable grinding/shredding/chipping system, according to the disclosure, diagrammatically showing both the improved pivotable housing and the feed roller in their raised substantially vertical positions, spaced from the rotor, to provide access to the rotor for servicing and maintenance thereof while ensuring that in the event of a hydraulic/mechanical failure, the pivotable housing (which forms an integral part of the grinding/shredding/chipping chamber), and the feed roller will not inadvertently pivot back toward their in-use positions and thereby possibly injuring any personnel working on or servicing the rotor.

However, if hydraulic. fluid is supplied, via the source of hydraulic pressure 18, to an opposite second side of the piston (not shown), accommodated within the feed roller hydraulic cylinder 48, so that the length of the feed roller hydraulic cylinder 48 is decreased, such decrease in the length of the feed roller hydraulic cylinder 48 causes the driven feed roller 30 to pivot, about the roller pivot 46, into a service position, as generally shown in FIG. 2, where the driven feed roller 30 is spaced away from the feed conveyor 26 thereby to assist with servicing or maintenance of the portable grinding/shredding/chipping system 2, as discussed below in further detail. It is to be appreciated that during operation of the portable grinding/shredding/chipping system 2, the flow of hydraulic fluid supplied to the driven feed roller 30 is controlled so that the driven feed roller 30 moves toward and away from the trailing end of the feed conveyor 26 to assist with feeding feed material into the grinding/shredding/chipping chamber 32.

The pivotable housing 42 is supported by the base frame 6 of the portable grinding/shredding/chipping system 2 and is pivotable relative thereto about a housing pivot 50. A pivotable housing hydraulic cylinder 52 couples the pivotable housing 42 to the base frame 6. When hydraulic fluid is supplied, via the source of hydraulic pressure 18, to a first side of the piston (not shown) accommodated within the pivotable housing hydraulic cylinder 52 so that the length of the pivotable housing hydraulic cylinder 52 is decreased, such decrease in the length of the pivotable housing hydraulic cylinder 52 causes the pivotable housing 42 to pivot about the housing pivot 50 into an in-use operative position, as shown in FIG. 1, where the pivotable housing 42 closes and seals a top portion of the grinding/shredding/chipping chamber 32 and assists with comminution of the feed material 4 by the rotor 16.

However, if hydraulic fluid is supplied, via the source of hydraulic pressure 18, to an opposite second side of the piston (not shown), accommodated within the pivotable housing hydraulic cylinder 52 so that the length of the pivotable housing hydraulic cylinder 52 is increased, such increase in the length of the pivotable housing hydraulic cylinder 52 causes the pivotable housing 42 to pivot, about the housing pivot 50, into the service position, as shown in FIG. 2, where the pivotable housing 42 is spaced away from the rotor 16 thereby to provide access to the rotor 16 to assist with servicing and/or maintenance thereof.

It is to be appreciated that when both the pivotable housing 42 and the driven feed roller 30 are located in their service positions (as shown in FIG. 2), the pivotable housing 42 is in a substantially vertical orientation while the driven feed roller 30 is located on a side of the pivotable housing 42 facing away from the rotor 16 and toward the trailing (discharge) end 54 of the portable grinding/shredding/chipping system 2. As a result of such position of the driven feed roller 30, the combined center of gravity C, of both the pivotable housing 42 and the driven feed roller 30, is toward the left of the housing pivot 50, e.g., "over center" toward the left hand side of this drawing, and thus at least the weight of the driven feed roller 30 continuously biases the pivotable housing 42 in a counter clockwise pivoting direction so as to maintain the servicing position.

When the pivotable housing hydraulic cylinder 52 is fully extended so that both the pivotable housing 42 and the driven feed roller 30 are an over center position, the pivotable housing hydraulic cylinder 52 forms a stop which prevents further counter clockwise rotation of the pivotable housing 42. Accordingly, the substantially vertical orientation of the pivotable housing 42 along with the combined center of gravity C being located on the left hand side of the housing pivot 50 thereby prevent the pivotable housing 42 and/or the driven feed roller 30 from pivoting or rotating back toward their operative positions. Accordingly, this over center arrangement provides a safety feature, during servicing and/or maintenance of the rotor 16, which prevents any inadvertent clockwise pivoting movement of the pivotable housing 42 and/or the driven feed roller 30, e.g., in the event that either of the feed roller and/or the pivotable housing cylinders 48, 52 malfunctions for some reason or there is a mechanical safety pin failure.

Figure 1B:
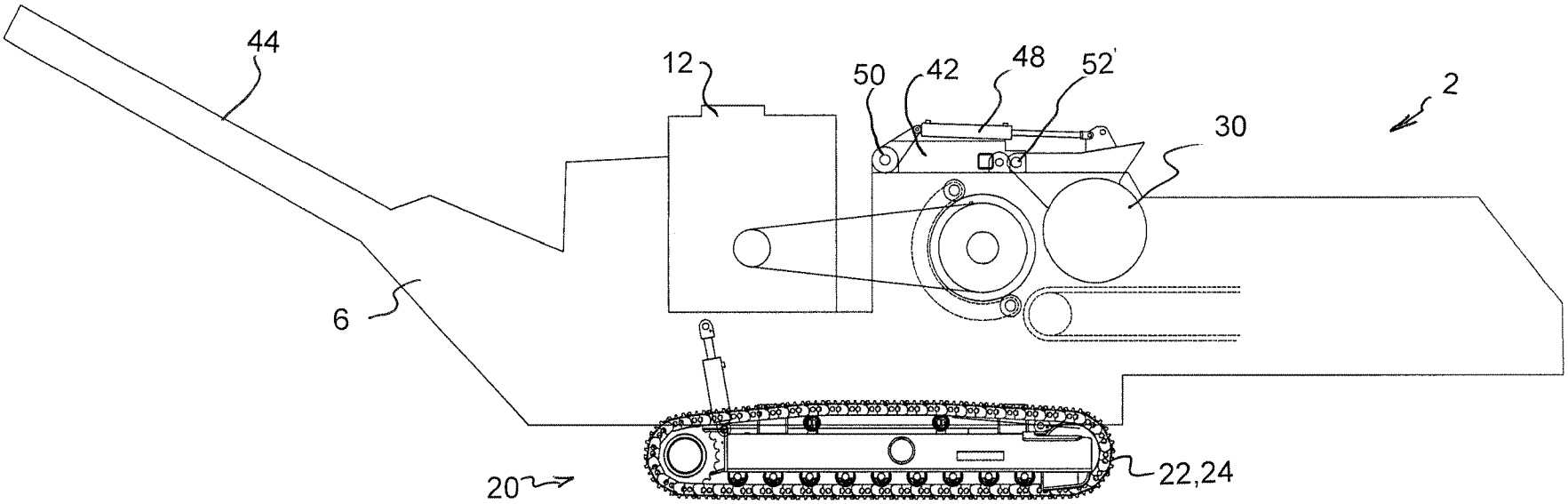
FIG. 1B is a diagrammatic right side elevational view of the portable grinding/shredding/chipping system, similar to FIG. 1, but with a rotating cylinder, instead of a conventional hydraulic cylinder, for rotating the pivotable housing into its open and closed positions.

In FIG. 1B, an alternative arrangement of the pivotably housing 42 is shown.

According to this embodiment, the pivotable housing hydraulic cylinder is replaced by a hydraulic rotating (rotational) cylinder 52' which is coincident with the housing pivot 50°. When hydraulic fluid is supplied, via the source of hydraulic pressure 18, to a first side of the hydraulic rotating (rotational) cylinder 52', the hydraulic rotating (rotational) cylinder 52' causes the pivotable housing 42 to pivot about the housing pivot 50 into an in-use operative position, as generally shown in FIG. 1B, where the pivotable housing 42 closes and seals a top portion of the grinding/shredding/chipping chamber 32 and assists with comminution of the feed material 4 by the rotor 16.

However, if hydraulic fluid is supplied, via the source of hydraulic pressure 18, to an opposite second side of the hydraulic rotating (rotational) cylinder 52', this the hydraulic rotating (rotational) cylinder 52' causes the pivotable housing 42 to pivot, about the housing pivot 50, into a service position, as generally shown in FIG. 2, where the pivotable housing 42 is spaced away from the rotor 16 and provides access to the rotor 16 to assist with servicing and/or maintenance thereof. As noted above, the combined center of gravity C, of both the pivotable housing 42 and the driven feed roller 30, is toward the left of the housing pivot 50, e.g., "over center" toward the left hand side of this drawing, and thus at least the weight of the driven feed roller 30 continuously biases the pivotable housing 42 in a counter clockwise pivoting direction so as to maintain the servicing position. As previously noted, this over center arrangement provides a safety feature, during servicing and/or maintenance of the rotor 16, which prevents any inadvertent clockwise pivoting movement of the pivotable housing 42 and/or the driven feed roller 30.

Figure 3:
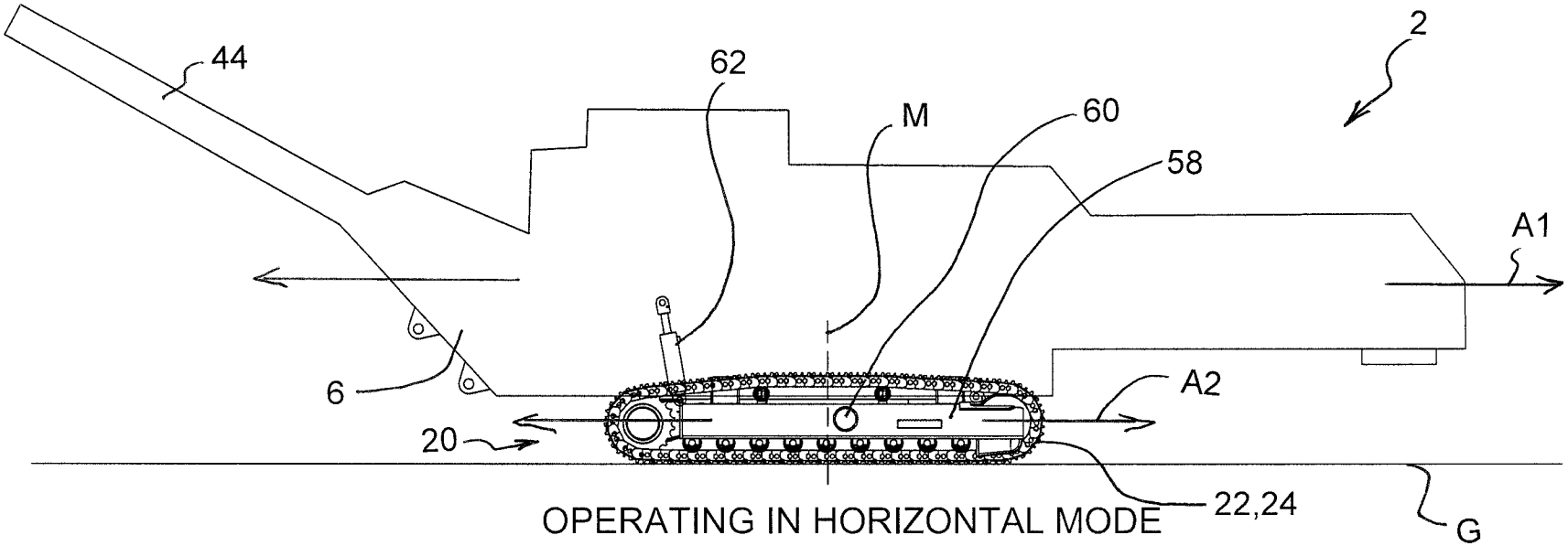
FIG. 3 is a diagrammatic right side elevational view of the portable grinding/shredding/chipping system, according to the disclosure, diagrammatically showing the improved drive track assembly in its standard operating mode or horizontal orientation.
Figure 4:
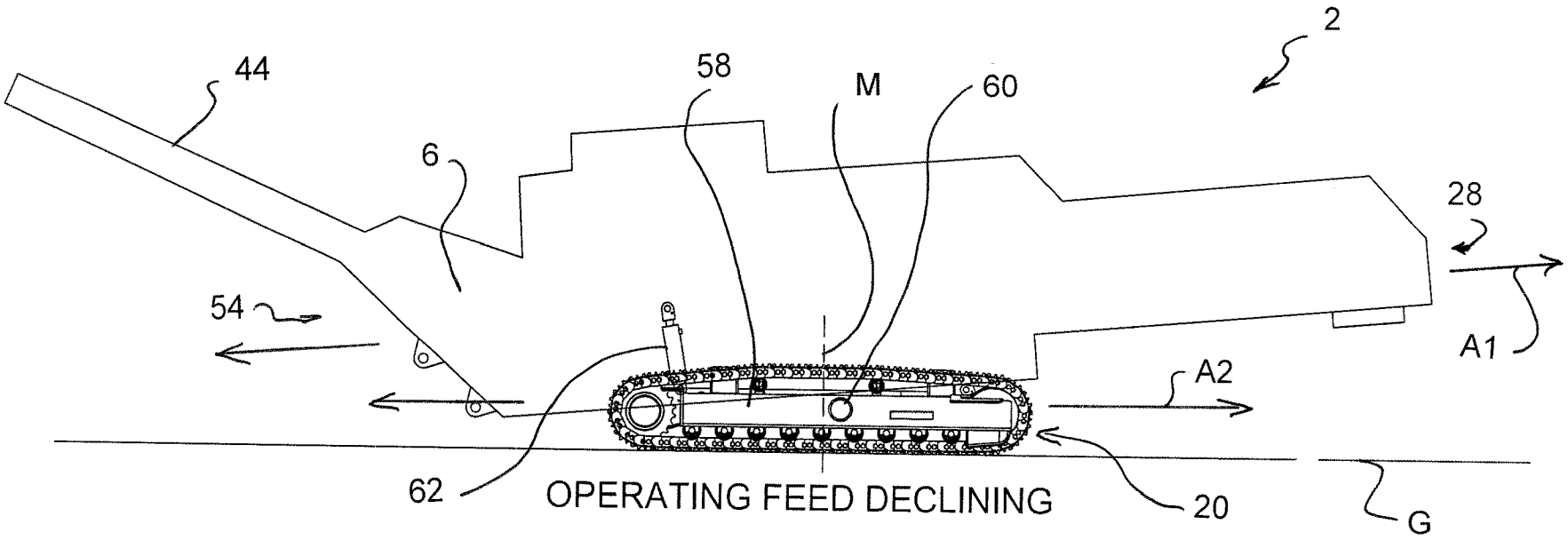
FIG. 4 is a diagrammatic right side elevational view of the portable grinding/shredding/chipping system, according to the disclosure, diagrammatically shown improved drive track assembly in a declined operating orientation to assist, with the assistance of gravity, feeding of shorter debris into the portable grinding/shredding/chipping system.
Figure 5:
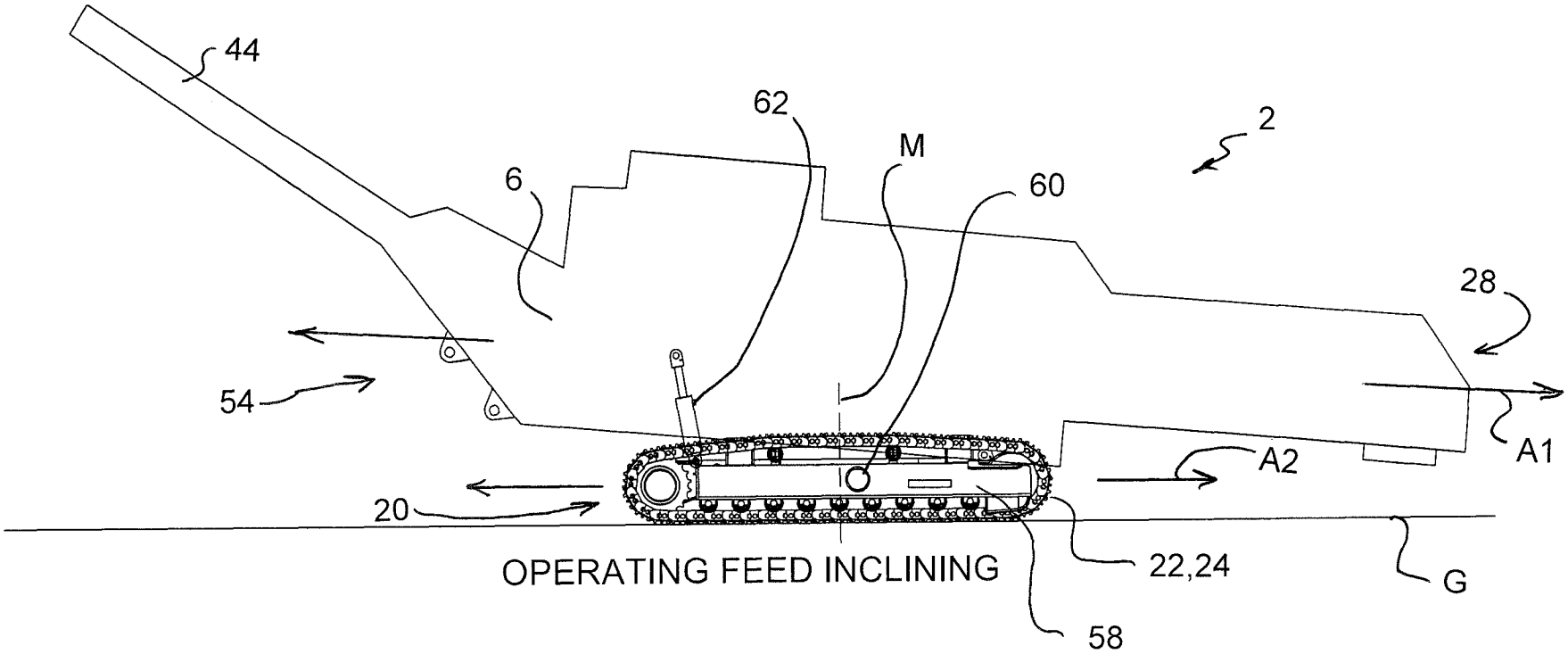
FIG. 5 is a diagrammatic right side elevational view of the portable grinding/shredding/chipping system, according to the disclosure, diagrammatically shown improved drive track assembly in an inclined operating orientation to assist with feeding longer logs, trees and debris into the portable grinding/shredding/chipping system.

Turning now to FIGS. 3-5, another aspect of the present invention will now be described and identical elements will be given identical reference numerals.

As generally shown, the drive track assembly 20 comprises the drive track framework 58 to which the first and second drive tracks 22, 24 are rotatably supported. The novel aspect of the drive track assembly 20, according to the disclosure, relates to how the two frameworks 58 of the drive track assembly 20 are coupled or otherwise connected to the bottom surface of the base frame 6 of the portable grinding/shredding/chipping system 2. According to the disclosure, each one of frameworks 58 of the drive track assembly 20 is connected to the base frame 6 generally at two separate and distinct connection points. The first connection point is a longitudinal pivotable connection 60 located between the respective framework 58, of the drive track assembly 20, and the base frame 6 which permits the respective framework 58 of the drive track assembly 20 to pivot relative to the base frame 6. This pivotable connection 60 is typically at or adjacent the midpoint M of the respective framework 58 of the drive track assembly 20, e.g., at the midpoint M or spaced a short distance such as 1-36 inches or so, forward of the midpoint M of the frameworks 58 of the drive track assembly 20 (i.e., toward the leading (feed) end 28 of the portable grinding/shredding/chipping system 2), Such pivotable connection 60 extends transversely across the portable grinding/shredding/chipping system 2 and may comprise one or more aligned connections points which together form the first pivotable connection 60 for each respective framework 58 of the drive track assembly 20 to the base frame 6. The purpose of this pivotable connection 60, between the frameworks 58 of the drive track assembly 20 and the base frame 6, will become apparent from the following discussion, In addition, the first one of the frameworks 58 of the drive track assembly 20 is connected to the base frame 6 via a first hydraulic cylinder, which is located on the opposite side of the midpoint M of the framework 58 relative to the pivotable connection 60 while the second one of the frameworks 58 of the drive track assembly 20 is connected to the base frame 6 via a second hydraulic cylinder, which is located on the opposite side of the midpoint M of the framework 58 relative to the pivotable connection 60. The first hydraulic cylinder 62 is located on a right first side of the portable grinding/shredding/chipping system 2, and forms the second connection point for the first framework 58, and the second hydraulic cylinder (not shown) is located on a left second side of the portable grinding/shredding/chipping system 2, and forms the second connection point for the second framework 58. Each one of the first and the second hydraulic cylinders 62 interconnects the base frame 6 of the portable grinding/shredding/chipping system 2 with a trailing (discharge) end of the respective framework 58 of the drive track assembly 20. Typically both of the second connection points of the first and the second hydraulic cylinders 62 with the trailing (discharge) end of the respective framework 58 of the drive track assembly 20 are at locations spaced from the midpoint M of the drive track assembly 20 and toward the trailing (discharge) end 54 of the portable grinding/shredding/chipping system 2, typically adjacent a rear end of the respective track frameworks 58, to provide sufficient leverage for pivoting the drive track assembly 20 relative to the portable grinding/shredding/chipping system 2, as discussed below in further detail.

The above described two connections of the respective frameworks 58 of the drive track assembly 20 to the base frame 6 of the portable grinding/shredding/chipping system 2 permit the drive track assembly 20 to alter the orientation of the drive track assembly 20 relative to a remainder of the portable grinding/shredding/chipping system 2. That is, as generally shown in FIG. 3, when both the first and second hydraulic cylinders 62 are in their intermediate (neutral) positions, a longitudinal axis A1, defined by the base frame 6 of the portable grinding/shredding/chipping system 2, generally extends parallel to a longitudinal axis A2, defined by the drive track assembly 20, e.g., the portable grinding/shredding/chipping system 2 is located in its standard operating position.

If hydraulic fluid is supplied, via the source of hydraulic pressure 18, to a first side of both of the pistons (not shown), accommodated within the first and second hydraulic cylinders 62, such that the length of both the first and the second hydraulic cylinders 62 are simultaneously decreased, such decrease in the length of both of the first and the second hydraulic cylinders 62 causes the trailing (discharge) end 54 of the portable grinding/shredding/chipping system 2 to move or pivot toward the ground or other supporting surface G, about the pivotable connection 60 between the frameworks 58 and the base frame 6, and correspondingly causes the leading (feed) end 28 of the portable grinding/shredding/chipping system 2 to move or pivot away from the ground or other supporting surface G, as generally shown in FIG. 4, Such operating feed declining orientation of the portable grinding/shredding/chipping system 2 is generally desirable when feeding shorter length forest products and other debris onto the feed conveyor 26 of the portable grinding/shredding/chipping system 2. That is, due to declining orientation of the portable grinding/shredding/chipping system 2, the grappler merely places the forest products or other debris on the feed conveyor 26 and, thereafter, the declining orientation, along with that assistance of gravity, assist with further feeding of the relatively short forestry products and other relatively short debris into the grinding/shredding/chipping chamber 32 for communition.

However, if hydraulic fluid is supplied, via the source of hydraulic pressure 18, to an opposite second side of both of the pistons (not shown), accommodated within the first and second hydraulic cylinders 62, so that the length of both the first and the second hydraulic cylinders 62 are simultaneously increased, such increase in the length of both of the first and the second hydraulic cylinders 62 causes the trailing (discharge) end 54 of the portable grinding/shredding/chipping system 2 to move or pivot away from the ground or other supporting surface G, about the pivotable connection 60 between the frameworks 58 and the base frame 6, and correspondingly causes the leading (feed) end 28 of the portable grinding/shredding/chipping system 2 to move or pivot toward the ground or other supporting surface G, as generally shown in FIG. 5. Such an operating feed inclining orientation of the portable grinding/shredding/chipping system 2 is generally desirable when feeding long or elongate logs, trees and other elongate debris onto the feed conveyor 26 of the portable grinding/shredding/chipping system 2, That is, due to the inclining orientation of the portable grinding/shredding/chipping system 2, a grappler generally only has to place a leading end of the long or elongate logs, trees and other debris onto the inlet end of the feed conveyor 26 and, thereafter, the inclined orientation of the portable grinding/shredding/chipping system 2 assists with feeding of the long or elongate logs, trees and other debris into the grinding/shredding/chipping chamber 32 for communition. Such inclining orientation typically avoids the need for the grappler to grab the long or elongate logs, trees and other debris one or more additional times, following initial placement of the long or elongate logs, trees and other debris on the feed conveyor 26, in order to adequately feed the same into the grinding/shredding/chipping chamber 32.

Alternatively, if hydraulic fluid is supplied, via the source of hydraulic pressure 18, to only one of the pistons (not shown), of either the first and the second hydraulic cylinders 62, so that the length of that first or the second hydraulic cylinder 62 is either increased or decreased in length, than one lateral side of the portable grinding/shredding/chipping system 2 will be tilted toward or away from the ground or other supporting surface G, about the pivotable connection 60.

Turning now to FIGS. 6-9, another benefit of the improved drive track assembly 20 of the present disclosure will now be described and identical elements will be given identical reference numerals.

Figure 6:
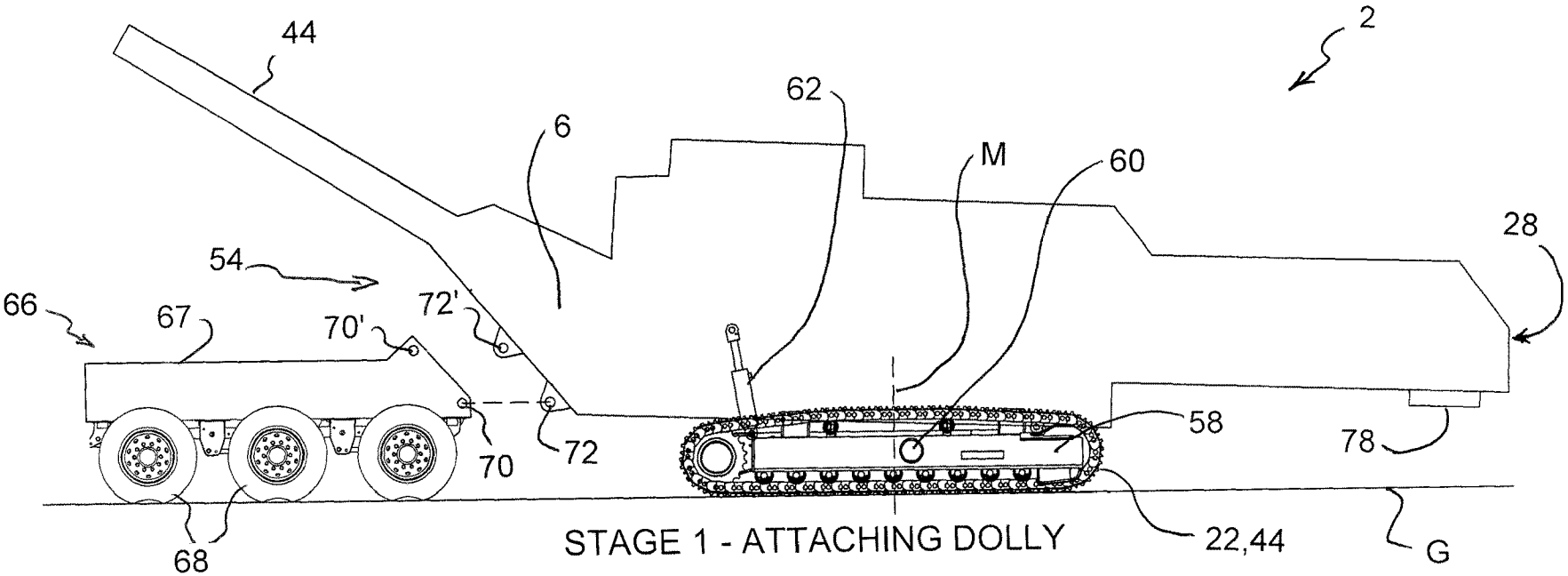
FIG. 6 is a diagrammatic right side elevational view of the portable grinding/shredding/chipping system, shown raising of the trailing (i.e., the discharge) end of the portable grinding/shredding/chipping system, via the drive track assembly, to facilitate attachment to a dolly.

As shown in FIG. 6, the improved drive track assembly 20 of the present disclosure can be utilized to facilitate attachment of the trailing (discharge) end 54 of the portable grinding/shredding/chipping system 2 to one end of a conventional dolly 66 to facilitate transportation of the portable grinding/shredding/chipping system 2 along a desired roadway or highway. As generally shown, the dolly 66 comprises a support platform 67 which is supported by three pairs of spaced apart rotational wheels 68 that facilitate travel of the dolly 66 along the desired roadway or highway. While the dolly 66 is shown with three pairs of wheels 68, is to be appreciated that the number of wheels/axles can be increased or decreased, depending upon the particular application and the size of the portable grinding/shredding/chipping system 2, without departing from the spirit and scope of the present disclosure.

In FIG. 6, the portable grinding/shredding/chipping system 2 is shown in a partially inclining orientation. That is, the trailing (discharge) end 54 is slightly higher in elevation than the leading (feed) end 28 of the portable grinding/shredding/chipping system 2. With the portable grinding/shredding/chipping system 2 in this orientation, the one or more lower most coupling feature(s) 70 of the dolly 66 can then be aligned with the one or more mating lower most coupling feature(s) 72 of the portable grinding/shredding/chipping system 2, It is to be appreciated that the portable grinding/shredding/chipping system 2 can be moved relative to the dolly 66, both toward and away from one another as well as adjust the vertically height of the one or more lower most coupling feature(s) 72 of the portable grinding/shredding/chipping system 2 relative to the one or more lower most coupling feature(s) 70 of the dolly 66, in order to align properly the through bores of each one of the one or more lower most coupling features 70, 72, of the dolly 66 and the portable grinding/shredding/chipping system 2, with one another.

Figure 7:
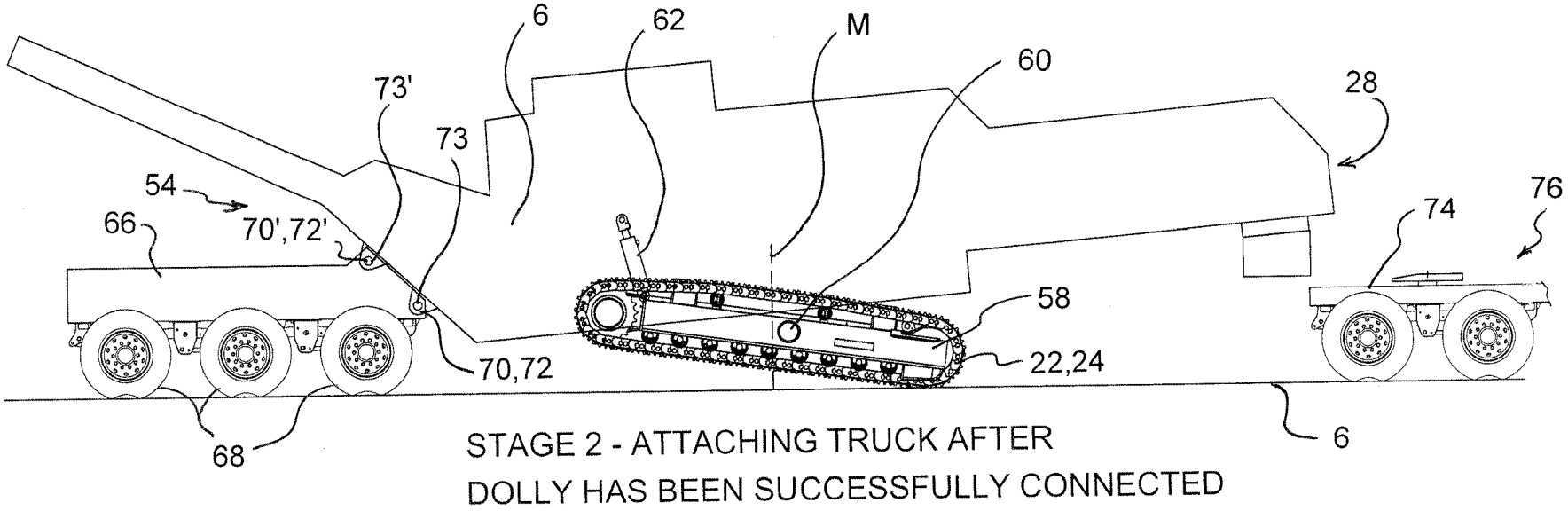
FIG. 7 is a diagrammatic right side elevational view of the portable grinding/shredding/chipping system, shown the trailing (i.e., the discharge) end of the portable grinding/shredding/chipping system attached to the dolly with the leading (i.e,, the feed) end of the portable grinding/shredding/chipping system being raised, via the drive track assembly, to facilitate attachment thereof to a tractor.

Once such alignment occurs, one or more rods, threaded fasteners, threaded bolts or other some conventional first coupling member 73 (only diagrammatically shown in FIG. 7) can then couple only the aligned and mating lower most coupling features 70, 72 with one another to attach partially the trailing (discharge) end 54 of the portable grinding/shredding/chipping system 2 to the dolly 66, as generally shown in FIG. 7, while still permitting the portable grinding/shredding/chipping system 2 to pivot relative to the dolly 66 about an axis defined by the conventional first coupling member 73, i.e., the trailing (discharge) end 54 of the portable grinding/shredding/chipping system 2 is only pivotably connected to the dolly 66 at this stage by a single connection.

Once the trailing (discharge) end 54 of the portable grinding/shredding/chipping system 2 is partially attached to the dolly 66 by only the lower most coupling features 70, 72 and the associated first coupling member 73, then the drive track assembly 20 can be operated again to supply hydraulic fluid, via the source of hydraulic pressure 18, to the opposite second side of both of the pistons (not shown), accommodated within the first and second hydraulic cylinders 62, so that the lengths of both the first and the second hydraulic cylinders 62 are simultaneously decreased. Since the trailing (discharge) end 54 of the portable grinding/shredding/chipping system 2 is now securely attached to the dolly 66 by the lower most coupling features 70, 72 and the associated first coupling member 73, such a decrease in the length of both of the first and the second hydraulic cylinders 62 causes, in turn, the leading (feed) end 28 of the portable grinding/shredding/chipping system 2 to pivot, about the axis defined by the conventional first coupling member 73, and move vertically away from the ground or some other supporting surface G, as generally shown in FIG. 7. Such movement also simultaneously raises a kingpin 78, permanently attached to an undersurface of the portable grinding/shredding/chipping system 2.

Figure 8:
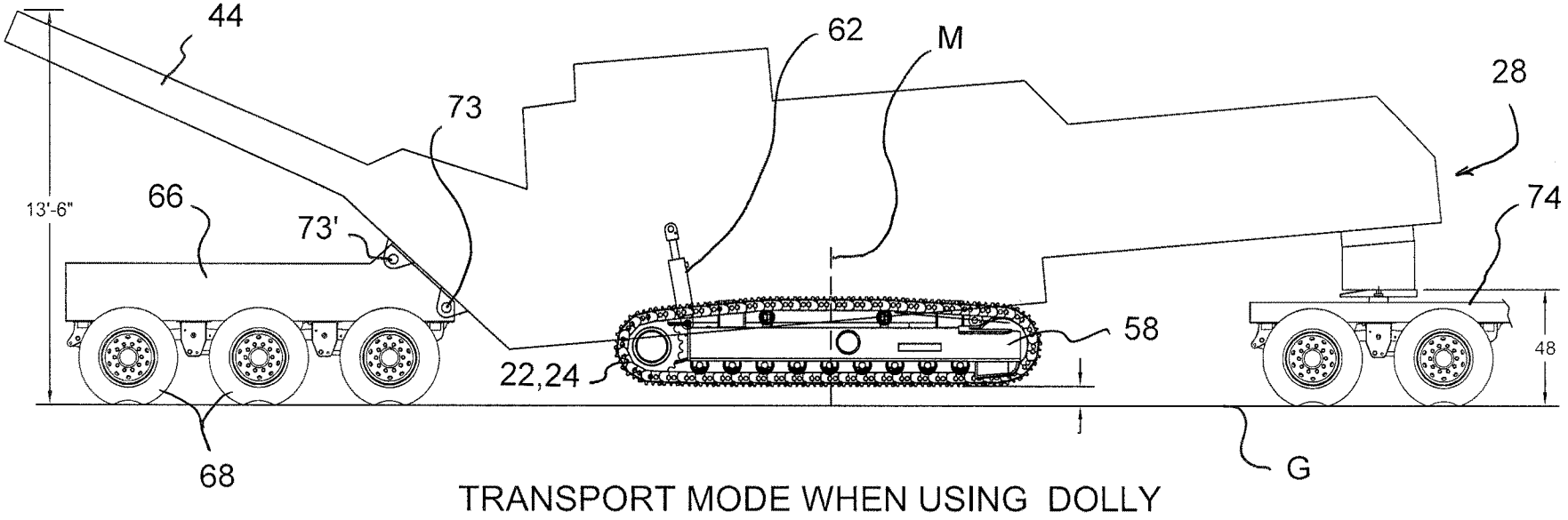
FIG. 8 is a diagrammatic right side elevational view of the portable grinding/shredding/chipping system, shown the raised leading (i.e., the feed) end of the portable grinding/shredding/chipping system attached to the rear portion of the tractor to facilitate transportation of the portable grinding/shredding/chipping system along a public road and highway without requiring a (lowboy) trailer.

After the leading (feed) end 28 of the portable grinding/shredding/chipping system 2 is sufficiently raised, then a rear portion 74 of a tractor 76 can then be positioned under the leading (feed) end 28 of the portable grinding/shredding/chipping system 2 and engage with the kingpin 78 in a conventional manner. Such engagement, between the rear portion 74 and the kingpin 78 facilitates coupling of the leading (feed) end 28 of the portable grinding/shredding/chipping system 2 to the tractor 76, as shown in FIG. 8, for transportation.

After the kingpin 78 engages with the rear portion 74 of the tractor 76, then the through bores of the two upper most coupling features 70', 72' are typically generally aligned with one another. If necessary, the improved drive track assembly 20 can be utilized to assist with any further alignment of the two upper most coupling features 70', 72' with one another. Thereafter, the two upper most coupling features 70', 72' are connect with one another, by another coupling member 73', to complete attachment of the portable grinding/shredding/chipping system 2 to the dolly 66.

Lastly, the improved drive track assembly 20 is manipulated to reposition the improved drive track assembly 20 in its standard (neutral) orientation so that the entire drive track assembly 20 extends parallel to and is generally spaced at least 8 inches or so above the ground G (see FIG. 8) to facilitate transportation of the portable grinding/shredding/chipping system 2 along a public road or highway.

Figure 9:
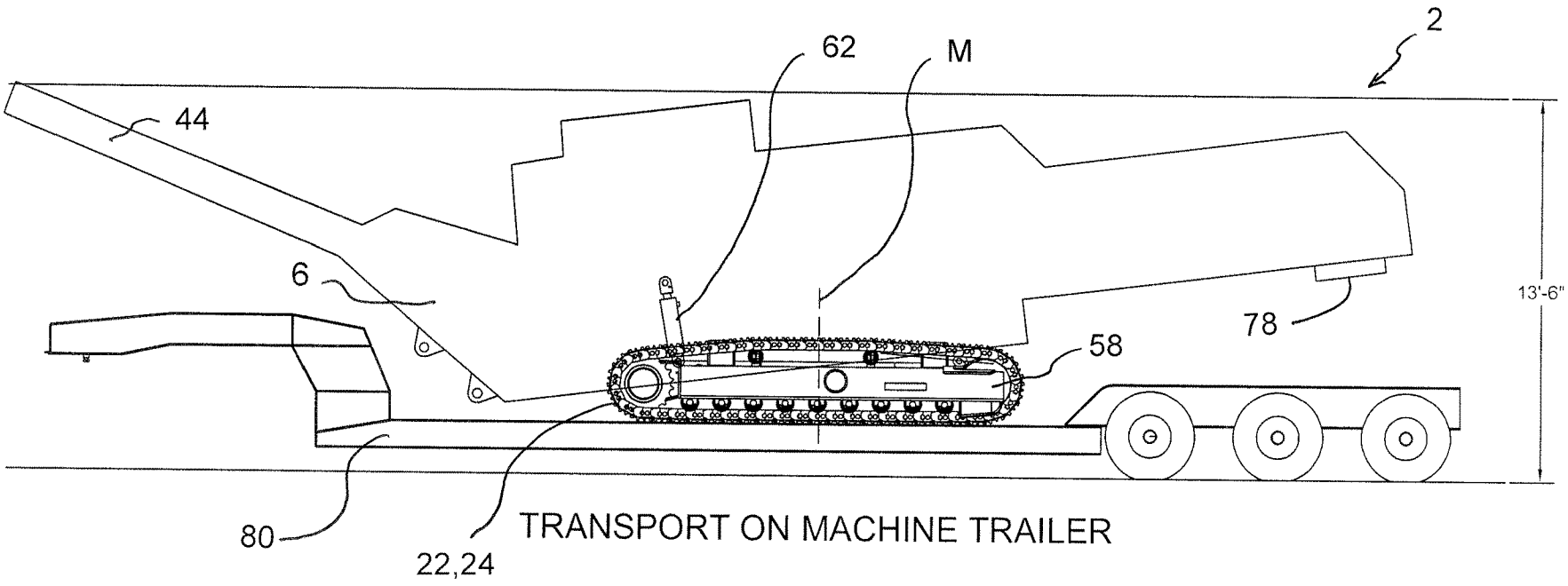
FIG. 9 is a diagrammatic right side elevational view of the portable grinding/shredding/chipping system, shown loaded on a conventional lowboy trailer, with the drive track assembly shown in a decline orientation to reduce the overall height of the portable grinding/shredding/chipping system to a height of 13 feet 6 inches or less for travel along public roads and highways.

Alternatively, in the event that the portable grinding/shredding/chipping system 2 is to be transported on a conventional lowboy trailer 80 (see FIG. 9), then the improved drive track assembly 20 can be operated to supply hydraulic fluid, via the source of hydraulic pressure 18, so as to reduce the overall height of the portable grinding/shredding/chipping system 2 on the lowboy trailer 80. That is, hydraulic fluid is supplied to the second side of both of the pistons (not shown), accommodated within the first and second hydraulic cylinders 62, so that the length of both the first and the second hydraulic cylinders 62 are simultaneously decreased to a certain extent. Such a decrease in the length of both of the first and the second hydraulic cylinders 62 causes the trailing (discharge) end 54 of the portable grinding/shredding/chipping system 2 to move or pivot toward the top surface of the lowboy trailer 80, about the pivotable connection 60 between the frameworks 58 of the drive track assembly 20 and the base frame 6, and correspondingly causes the leading (feed) end 28 of the portable grinding/shredding/chipping system 2 to move or pivot away from the top surface of the lowboy trailer 80 a corresponding distance, as generally shown in FIG. 9. As a result of sufficient manipulation of the track drive assembly 20, the overall height of the portable grinding/shredding/chipping system 2, when loaded on the lowboy trailer 80, can be readily modified so as to be no greater than 13 feet 6 inches and thereby facilitate safe transportation of the portable grinding/shredding/chipping system 2 along public roads and highways.

Figure 7A:
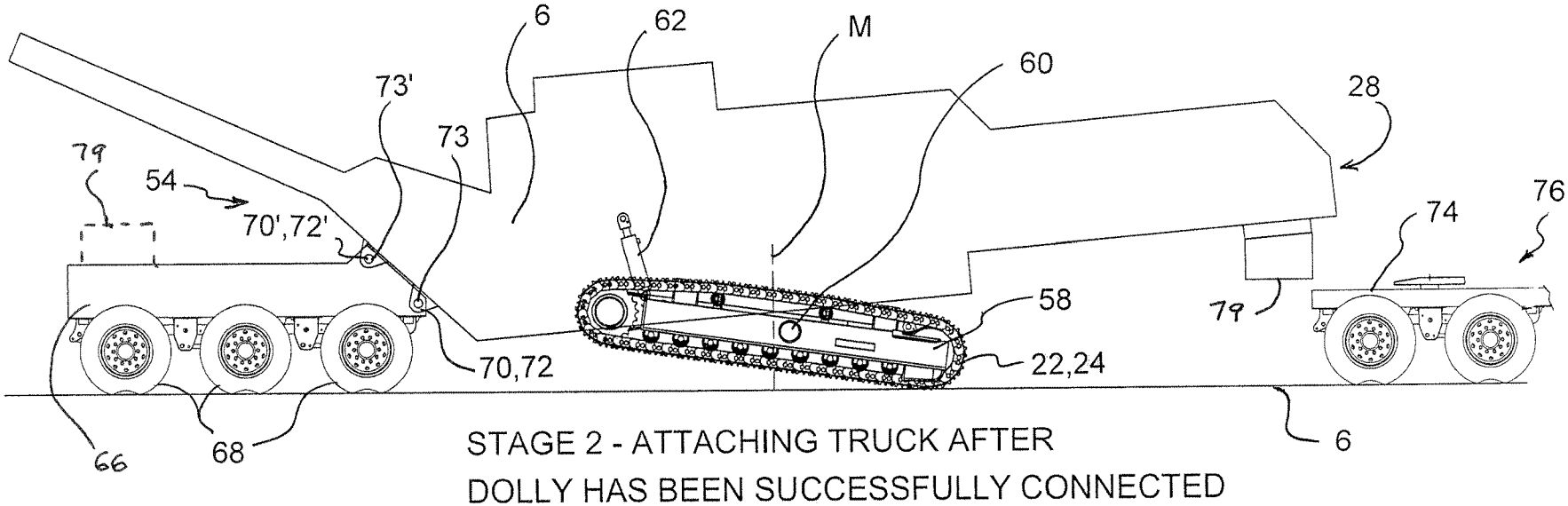
FIG. 7A is a diagrammatic right side elevational view of the portable grinding/shredding/chipping system, shown the trailing (i.e., the discharge) end of the portable grinding/shredding/chipping system attached to the dolly with the leading (i.e., the feed) end of the portable grinding/shredding/chipping system being raised, via the drive track assembly, to facilitate attachment thereof to a tractor.

FIG. 7A is a diagrammatic right side elevational view of the portable grinding/shredding/chipping system, shown a modification of the kingpin. According to this embodiment, the kingpin comprises a removable kingpin assembly 79 which is removably attached, by a conventional quick disconnect mechanism, e.g., a plurality of bolts, fasteners, etc., to an undersurface of a leading end of the portable grinding/shredding/chipping system 2 to facilitate coupling of the leading end thereof to a tractor for transportation of the portable grinding/shredding/chipping system 2. It is to be appreciated that the removable kingpin assembly 79 is generally only attached to the undersurface of the portable grinding/shredding/chipping system 2 either during transportation or when the portable grinding/shredding/chipping system 2 is being prepared for transportation. At all other times, the removable kingpin assembly 79 is typically disconnected from the undersurface of the portable grinding/shredding/chipping system 2 and typically temporarily stored on the dolly, as shown in dashed lines in FIG. 7A, so that the removable kingpin assembly 79 does not interfere with the inclining feature/operation of the portable grinding/shredding/chipping system 2.

Turning now to FIGS. 10, 10A, 10B and 11, further modifications of the present disclosure will now be described. As these embodiments are very similar to the previously discussed embodiments, only the differences between these modifications and the previous embodiments will be discussed in detail while identical elements will be given identical reference numerals, The primary difference between the modification and the previous embodiments relates to the drive arrangement. According to this embodiment, the engine sheave 14 drives an intermediate shaft 82 which, in turn, drives the rotor 16. As a result of use of the intermediate shaft 82, the counter clockwise rotation of the engine sheave 14 results in a counter clockwise rotation of the intermediate shaft 82 and, correspondingly, a clockwise (downswing) rotation of the rotor 16. Due to the clockwise (downswing) rotation of the rotor 16, the location of the anvil 36 is positioned, according to this modification, so as to be located below the rotational axis of the rotor 16 (instead of above the rotational axis) and thereby initiates comminution of the feed material 4 as the feed material enters into the grinding/shredding/chipping chamber 32.

As is conventional in the art, the anvil 36 is spaced a small distance from the rotor 16 and is biased, e.g., either by hydraulic pressure or a spring (not shown in detail), toward the rotor 16 so that the anvil 36 is retained closely adjacent, but spaced from the rotor 16. Such biasing of the anvil 36, toward the rotor 16, permits the anvil 36 to be forced away from the rotor 16 in the event that tramp metal, or some other hard material, passes between the rotor 16 and the anvil 36, thereby typically avoiding any damage from occurring, during operation, to the components of portable grinding/shredding/chipping system 2.

Figure 10:
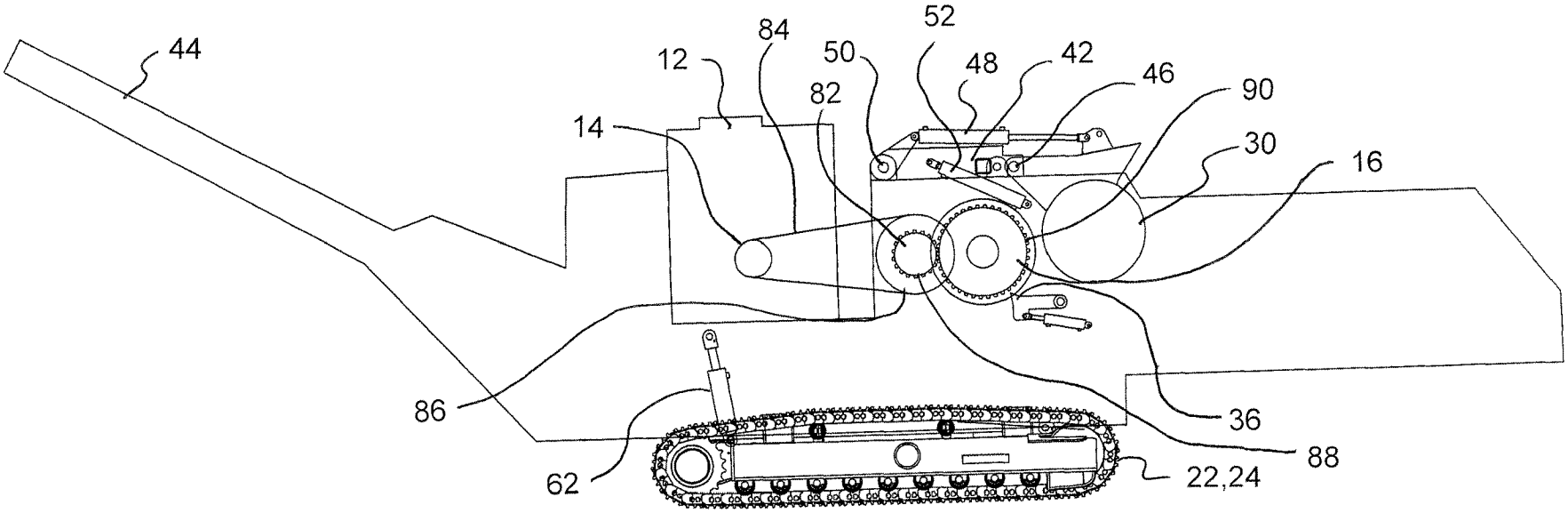
FIG. 10 is a diagrammatic right side elevational view of the portable grinding/shredding/chipping system, according to the disclosure, diagrammatically showing an intermediate drive member which facilitates driving of the rotor in a clockwise (downswing) rotational direction, for comminuting of the feed material, with the pivotable housing shown in its normal in use position.
Figure 10A:
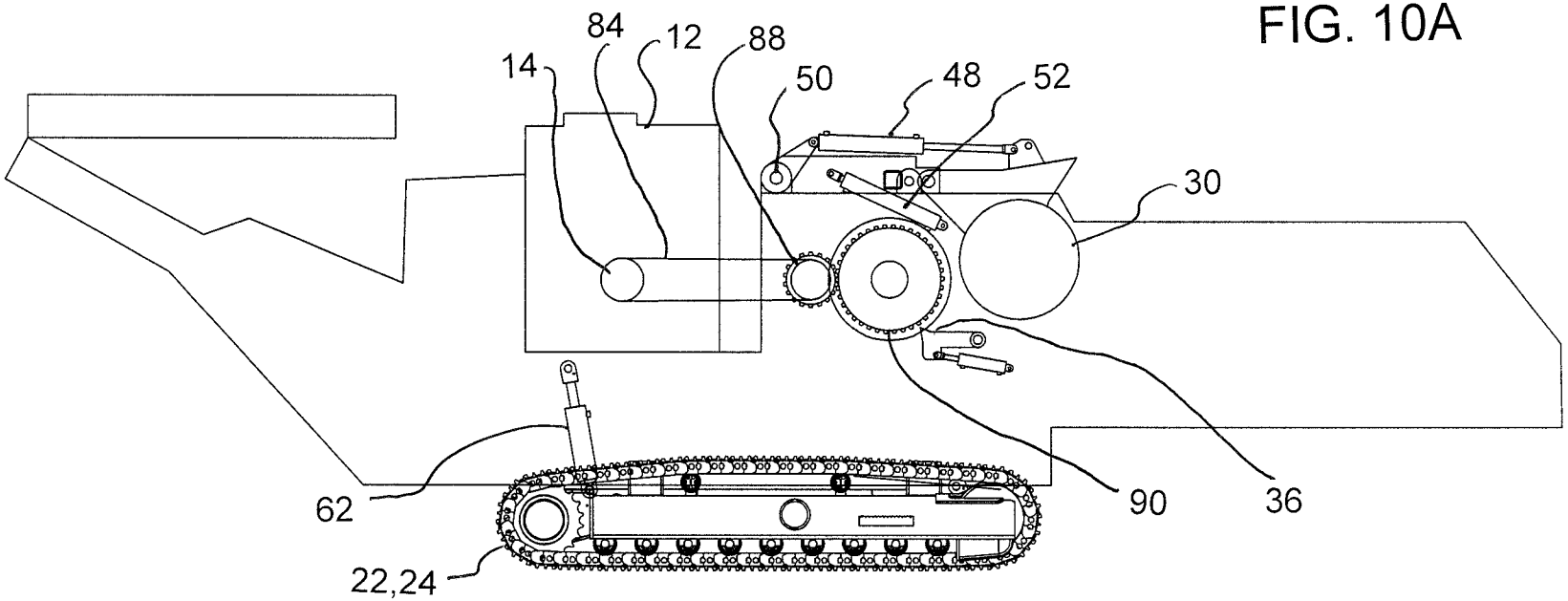
FIG. 10A is a diagrammatic right side elevational view of the portable grinding/shredding/chipping system, similar to FIG. 10, but with the belt drive transferring the drive from the engine to the intermediate gear without any speed reduction.

As generally shown in these Figures, a drive belt 84 couples the engine sheave 14 to an intermediate shaft sheave 86 which, in turn, causes the intermediate shaft 82 to rotate in a counter clockwise direction. As shown in FIG. 10, the diameter of the intermediate shaft sheave 86 is typically three times a diameter of the engine sheave 14 which thereby results in a rotational speed reduction of 3 to 1, e.g., a speed reduction by one third. Accordingly, if the engine sheave 14 is rotating in a counter clockwise rotational direction at a rotational speed of about 1,800 RPM, for example, then the intermediate shaft 82 will rotate in a counter clockwise rotational direction at a rotational speed of about 600 RPM.

An intermediate gear 88 of the intermediate shaft 82 engages with a mating gear 90, provided on the rotor 16, and this gear arrangement, in turn, causes the rotor 16 to rotate in a clockwise (downswing) rotational direction. A diameter of the mating gear 90 of the rotor 16 is typically three times a diameter of the intermediate gear 88 of the intermediate shaft 82 which again thereby results in a rotational speed reduction of 3 to 1, e.g., a reduction of one third. Accordingly, if the intermediate shaft 82 is rotating in a counter clockwise rotational direction at a rotational speed of about 600 RPM, for example, then the rotor 16 will be rotated in a clockwise (downswing) rotational direction at a rotational speed of about 200 RPM.

It is to be appreciated that by merely replacing/changing the drive belt 84 and either the engine sheave 14 and/or the intermediate shaft sheave 86, for example, the supplied rotational drive to the portable grinding/shredding/chipping system 2 can be readily altered or modified. For example, if the intermediate shaft sheave 86 was replaced so as to have the same diameter the engine sheave 14 or vice versa (see FIG. 10A), then no rotational speed reduction will occur therebetween. Alternatively, if the intermediate shaft sheave 86 was replaced with an intermediate shaft sheave 86 which is twice the size of the engine sheave 14, then only a 2 to 1 rotational speed reduction from the engine 12 occurs, e.g., the rotational speed of the engine 12 is reduced from 1,800 RPM to 900 RPM, for example.

It is to be appreciated that the rotational speed of the rotor 16 can be easily modified or changed, on-site for example, in order to comminute different types of feed material 4 or achieve varying degrees of comminutation of the feed material 4 by merely replacing at least one sheave 86 and the drive belt 84. For example, if the production of larger sized chips is desired, the rotor 16 will typically rotate at a slower rotational speed, e.g., 200 RPM, while if production of more uniform sized chips is desired, the rotor 16 will typically rotate at a faster rotational speed, e.g., 600 or 700 RPM.

Figure 10B:
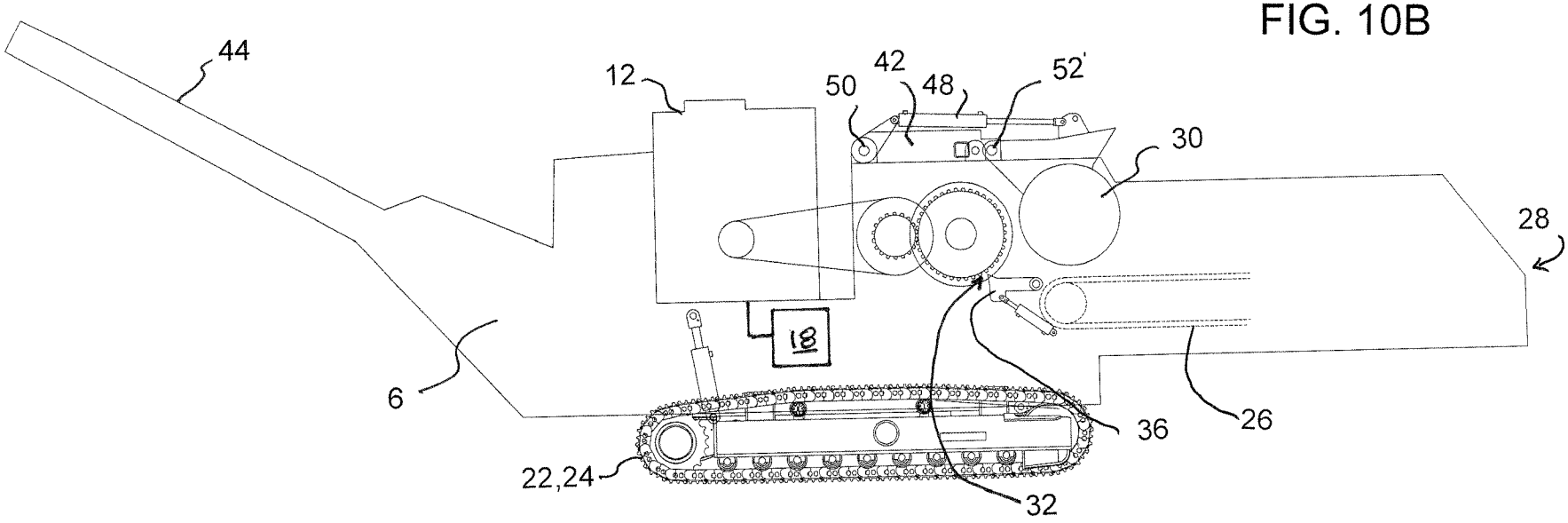
FIG. 10B is a diagrammatic right side elevational view of the portable grinding/shredding/chipping system, similar to FIG. 10, but with a rotating cylinder, instead of a conventional hydraulic cylinder, for rotating the pivotable housing into its open end closed positions.

In FIG. 10B, an alternative arrangement of the pivotably housing 42 is shown.

According to this embodiment, the pivotable housing hydraulic cylinder is replaced with a hydraulic rotating (rotational) cylinder 52' which is coincident with the housing pivot 50'. When hydraulic fluid is supplied, via the source of hydraulic pressure 18, to a first side of the hydraulic rotating (rotational) cylinder 52', the hydraulic rotating (rotational) cylinder 52' causes the pivotable housing 42 to pivot about the housing pivot 50 into an in-use operative position as shown, where the pivotable housing 42 closes and seals a top portion of the grinding/shredding/chipping chamber 32 and assists with comminution of the feed material 4 by the rotor 16. When hydraulic fluid is supplied, via the source of hydraulic pressure 18, to a second side of the hydraulic rotating (rotational) cylinder 52', the hydraulic rotating (rotational) cylinder 52' causes the pivotable housing 42 to pivot about the housing pivot 50 into a service position (similar to FIG. 11), where the pivotable housing 42 is rotated away from the top portion of the grinding/shredding/chipping chamber 32 and to assist with servicing of the rotor 16.

Figure 11:
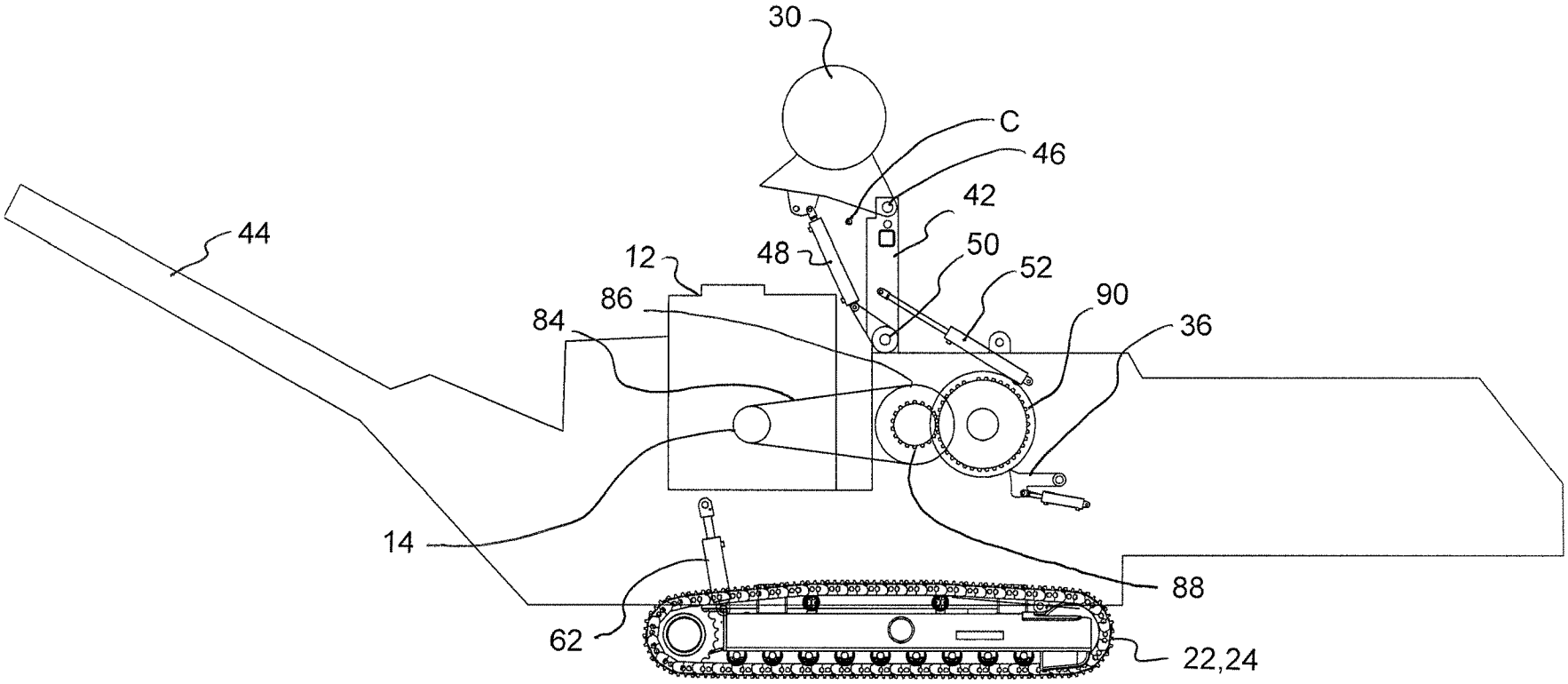
FIG. 11 is a diagrammatic right side elevational view of the portable grinding/shredding/chipping system, according to the disclosure, diagrammatically showing an intermediate drive member which facilitates driving of the rotor in a clockwise (downswing) rotational direction, for comminuting of the feed material, with the pivotable housing shown in its raised, service position.

FIG. 11 shows both the pivotable housing 42 and the driven feed roller 30 located in their service positions in which the pivotable housing 42 is in a substantially vertical orientation while the driven feed roller 30 is located on a side of the pivotable housing 42 facing away from the rotor 16 and toward the trailing (discharge) end 54 of the portable grinding/shredding/chipping system 2. As a result of such position of the driven feed roller 30, the combined center of gravity C, of both the pivotable housing 42 and the driven feed roller 30, is toward the left of the housing pivot 50 e.g., "over center" toward the left hand side of this drawing, and thus at least the weight of the driven feed roller 30 continuously biases the pivotable housing 42 in a counter clockwise pivoting direction so as to maintain the servicing position. This over center arrangement provides a safety feature, during servicing and/or maintenance of the rotor 16, which prevents any inadvertent clockwise pivoting movement of the pivotable housing 42 and/or the driven feed roller 30, e.g., in the event that either of the feed roller and/or the pivotable housing cylinders 48, 52 malfunctions for some reason or there is a mechanical safety pin failure.

Figure 12:
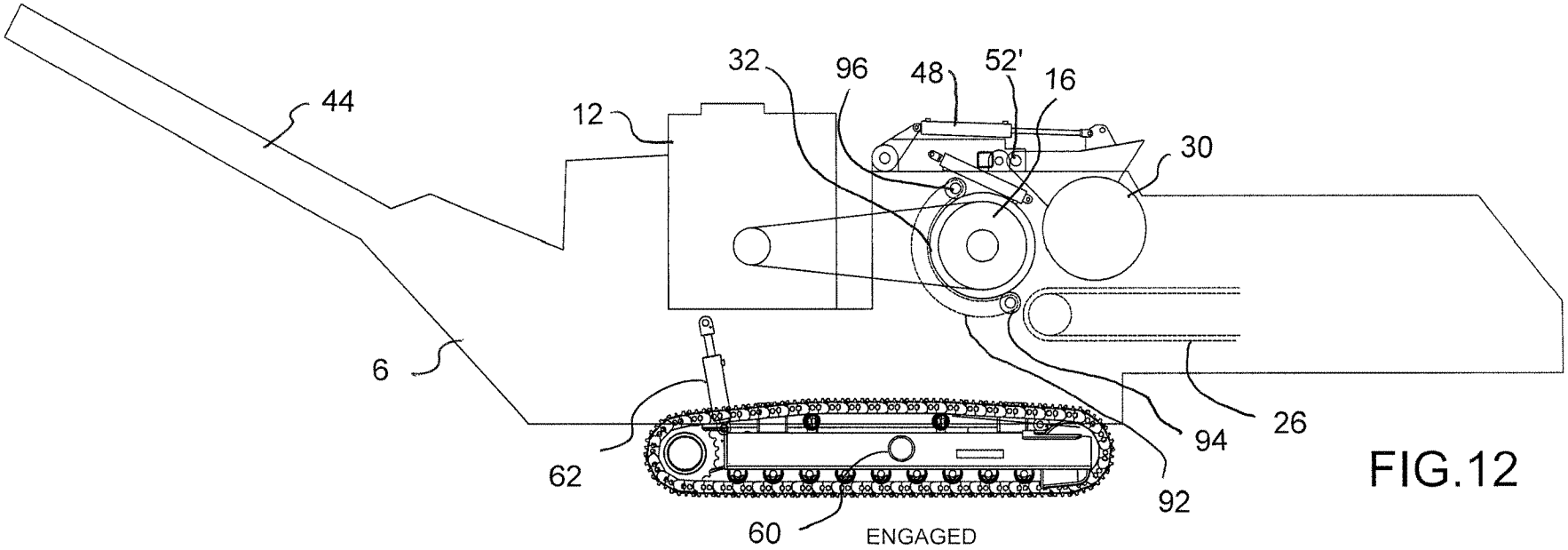
FIG. 12 is a diagrammatic right side elevational view of the portable grinding/shredding/chipping system, according to the disclosure, diagrammatically showing the anvil-screen combination of the rotor housing in an engaged in-use position to facilitate reducing the feed material being feed into the grinding/shredding/chipping chamber in an upswing style counter clockwise rotational rotor configuration.

Turning now to FIGS. 12 thorough 15, a further modification of the present disclosure will now be described. As this embodiment is very similar to the previously discussed embodiments, only the differences between this modification and the previous embodiments will be discussed in detail while identical elements will be given identical reference numerals.

Figure 13:
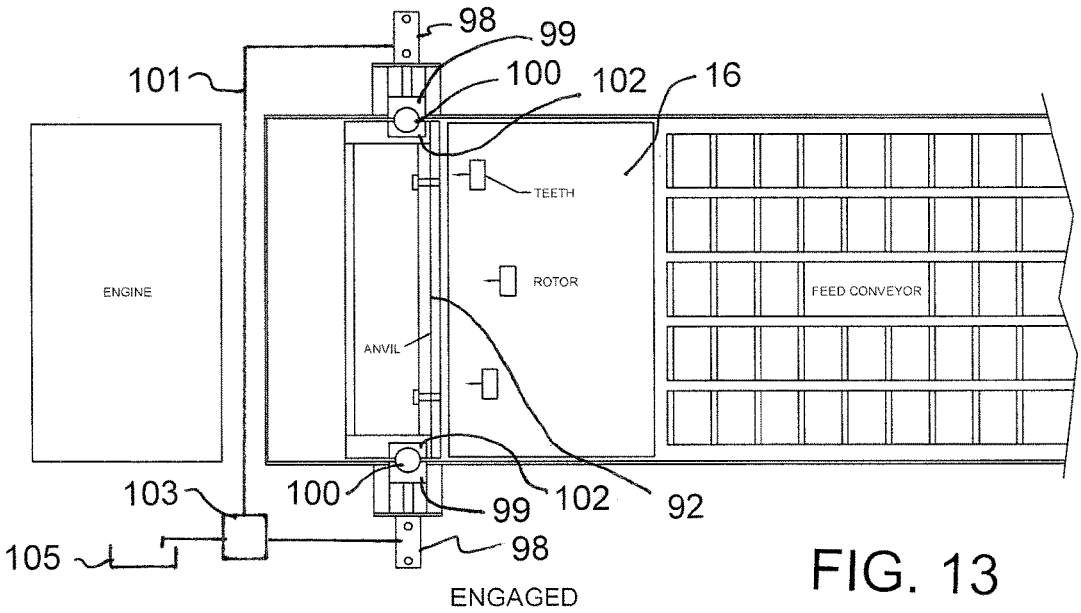
FIG. 13 is a diagrammatic top plan view of FIG. 12 showing the anvil-screen combination of the rotor housing in the engaged in-use position which facilitates reducing the feed material by the teeth/strikers supported on the exterior surface of the rotor.
Figure 15:
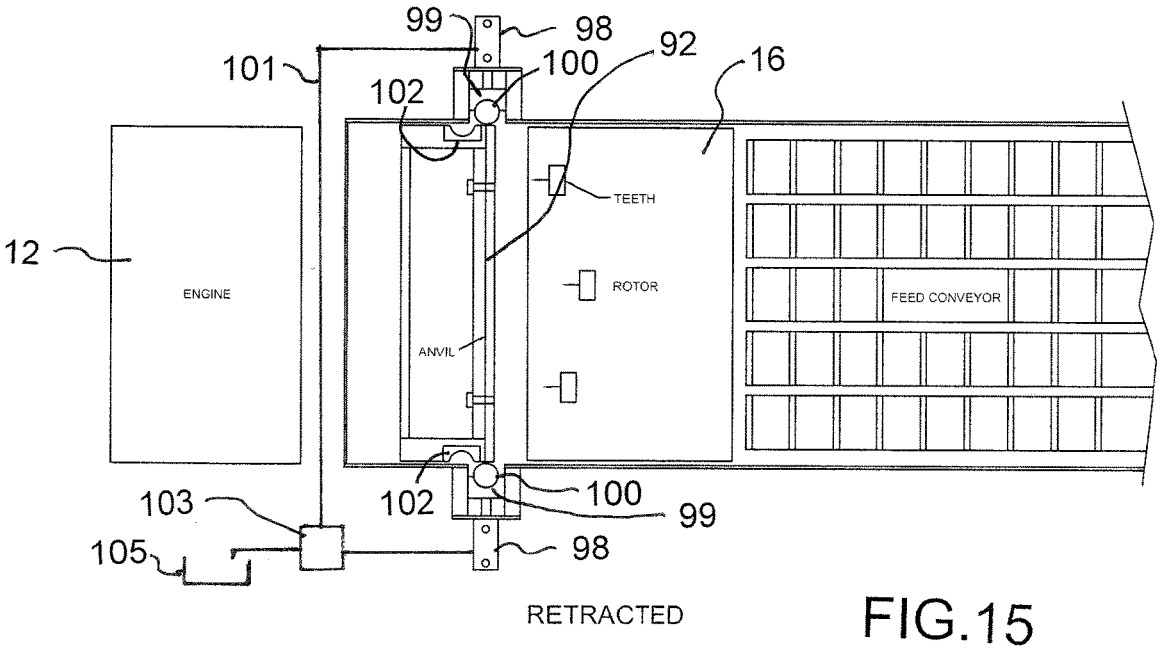
FIG. 15 is a diagrammatic top plan view of FIG. 14 showing the anvil-screen combination of the rotor housing in the retracted position, spaced from the teeth/strikers supported on the exterior surface of the rotor, to avoid damage to the anvil-screen combination as well as assist with maintenance, servicing and/or removal/replacement of the anvil-screen combination.
Figure 14:
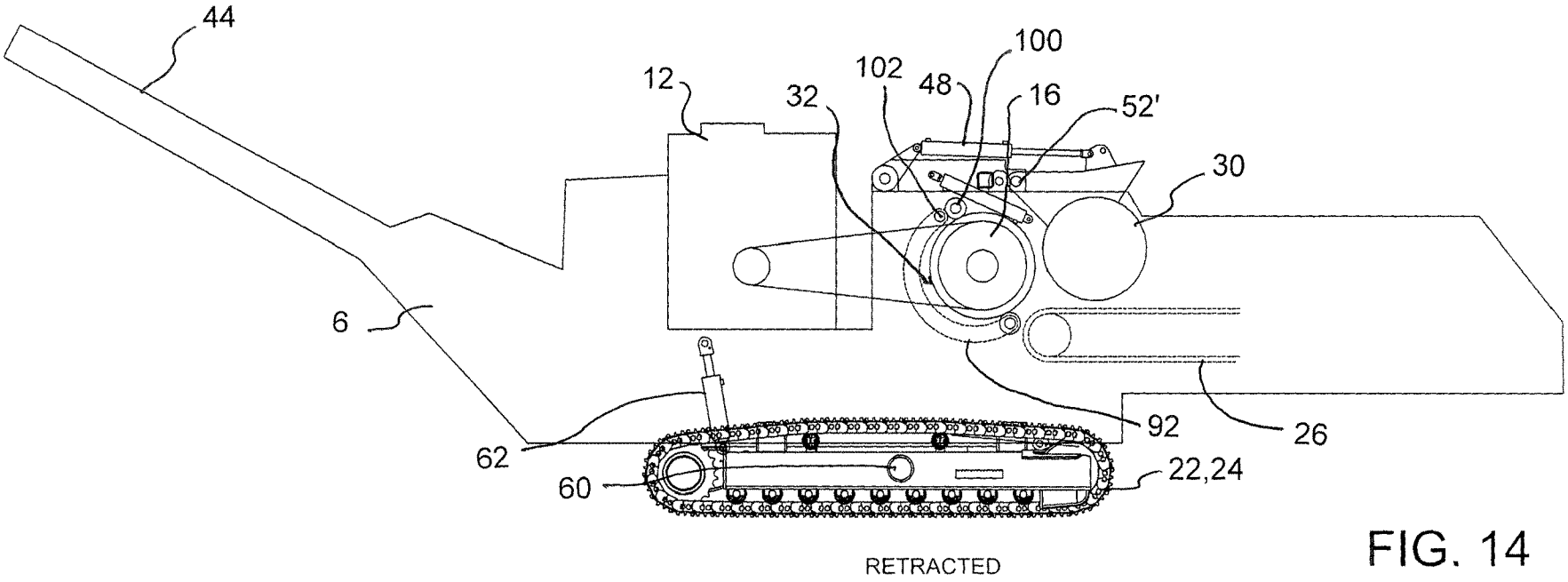
FIG. 14 is a diagrammatic right side elevational view of the portable grinding/shredding/chipping system, according to the disclosure, diagrammatically showing the anvil-screen combination of the rotor housing in a retracted position, spaced away from the rotor, so as to avoid damage to the anvil-screen combination as well as to facilitate servicing, maintenance and/or removal/replacement of the screen.

FIGS. 12 and 13 show the anvil-screen combination 92 of the grinding/shredding/chipping chamber 32 in an engaged in-use position located closely adjacent the exterior surface of the rotor 16 so as to facilitate comminution of the feed material 4 being feed into the grinding/shredding/chipping chamber 32, while FIGS. 14 and 15 show the anvil-screen combination 92 of the rotor housing in a retracted position, spaced sufficiently away from the teeth of the rotor 16, so as to prevent any damage from occurring to components of the rotor 16, e.g., the teeth or mounting platforms, during comminution as well as facilitate servicing, maintenance and/or replacement of the anvil-screen combination 92. As generally shown, the lower end 94 of the anvil-screen combination 92 is fixedly, but pivotably attached to the base frame 6 while the upper end 96 of the anvil-screen combination 92 is releasably attached to the base frame 6 by a pair of opposed anvil-screen hydraulic (or possibly pneumatic) cylinders 98 (see FIGS. 13 and 15). The pair of opposed anvil-screen hydraulic cylinders 98 are provided for facilitating releasable engagement between the leading end of the pair of opposed anvil-screen hydraulic cylinders 98 and the upper end 96 of the anvil-screen combination 92. As generally shown these figures, the anvil-screen combination 92 is normally engaged by the pair of opposed anvil-screen hydraulic cylinders 98 so as to be retained closely adjacent the exterior surface of the rotor 16, e.g., within a few inches or so.

As shown in FIGS. 13 and 15, the pair of opposed anvil-screen hydraulic cylinders 98 are axially aligned with one another and respective pistons (not shown), accommodated within each of the respective anvil-screen hydraulic cylinders 98, are biased toward one another by the hydraulic fluid supplied via the source of hydraulic pressure 18. The leading end each one of the anvil-screen hydraulic cylinders 98 supports an indentation or recess 99 which supports a spherical member or ball 100, e.g., an approximately 4 inch metallic ball, etc., while a mating side surface of each opposed side of the anvil-screen combination 92 has a corresponding or mating indentation or recess 102 which is sized to matingly receive and engage with the adjacent spherical ball or member 100 of the leading end of the respective anvil-screen hydraulic cylinder 98. As a result of such arrangement, both of pistons (not shown) of the anvil-screen hydraulic cylinders 98 are biased toward one another and thereby sandwich the anvil-screen combination 92 therebetween so as to maintain the anvil-screen combination 92 in its engaged in-use position (see FIG. 12), located closely adjacent the exterior surface of the rotor 16, which facilitate comminution of the feed material 4 being feed into the grinding/shredding/chipping chamber 32.

Normally, both of the anvil-screen hydraulic cylinders 98 are supply with the same hydraulic pressure so as to maintain a constant retaining force against both sides of the anvil-screen combination 92 and maintain the anvil-screen combination 92 in its engaged in-use position located closely adjacent the exterior surface of the rotor 16, as generally shown in FIGS. 12 and 13. Both of the anvil-screen hydraulic cylinders 98 are hydraulically connected to one another by a hydraulic line 101 so both of the anvil-screen hydraulic cylinders 98 are maintained at the same hydraulic pressure. A pressure relief valve 103, having an adjustable pressure release value, is located along the hydraulic line 101. In the event that the hydraulic pressure in either one of the anvil-screen hydraulic cylinders 98 exceeds the pressure limit of the pressure relief valve 103, then hydraulic fluid is automatically released by the pressure relief valve 103 and supplied to a supply tank 195 thereby relieving the pressure in each one of the anvil-screen hydraulic cylinders 98 which allows the anvil-screen combination 92 to pivot away from the rotor 16 avoid any damage from occurring, during operation, to the components of portable grinding/shredding/chipping system 2.

If a large hydraulic pressure is applied to the anvil-screen hydraulic cylinders 98, then the anvil-screen hydraulic cylinders 98 apply a large retaining force to the anvil-screen combination 92 while, conversely, if a small hydraulic pressure is applied to the anvil-screen hydraulic cylinders 98, then the anvil-screen hydraulic cylinders 98 apply a small retaining force to the anvil-screen combination 92. Accordingly, in the event that tramp metal, or some other hard material (not shown), becomes located or sandwiched between the exterior surface of the rotor 16 and inwardly facing surface of the anvil-screen combination 92, the anvil-screen combination 92 can overcome the retaining force, applied by the anvil-screen hydraulic cylinders 98, and thereby activate the adjustable pressure relief valve 103 to release the hydraulic pressure so that the anvil-screen combination 92 can be rapidly move into its retracted position, as shown in FIGS. 14 and 15, and thereby avoid damage from occurring to the rotor 16 and other components of portable grinding/shredding/chipping system 2. As a result, the two mating indentations or recesses 102 become dislodged or disengaged from the respective spherical member or ball 109, supported adjacent the leading end of the respective anvil-screen hydraulic cylinder 98, and thereby permit movement of the anvil-screen combination 92 from its engaged in-use position (FIGS. 12 and 13) into its retracted position (FIGS. 14 and 15). Such moment of the anvil-screen combination 92 generally avoids any damage from occurring to the anvil-screen combination 92.

After the anvil-screen combination 92 becomes disengaged from the anvil-screen hydraulic cylinders 98, then the hydraulic pressure supplied to the anvil-screen hydraulic cylinders 98 is reduced or discontinued. Thereafter, the two mating indentations or recesses 102 are moved, by service personnel, back into align with the respective spherical member or ball 100 of the respective anvil-screen hydraulic cylinders 98. Lastly, hydraulic pressure is again supplied to the anvil-screen hydraulic cylinders 98 to maintain the anvil-screen combination 92 in its engaged in-use position (FIGS. 12 and 13) and again maintain the anvil-screen combination 92 in the in-use engaged position.

In the event that servicing, other maintenance or replacement of the anvil-screen combination 92 is required or desired, then the hydraulic pressure supplied to the anvil-screen hydraulic cylinders 98 is discontinued or the pressure relieve valve 103 is actuated. Thereafter, the two mating indentations or recesses 102 generally disengage from respective spherical member or ball 100 of the respective anvil-screen hydraulic cylinder 98 which permits either gravity, or possibly operator involvement, to move or pivot the anvil-screen combination 92 from its in-use engaged position into its retracted position. Such moment of the anvil-screen combination 92 thereby assists with servicing, maintenance or replacement of the anvil-screen combination 92.

Once such servicing, maintenance or replacement is completed, then the two mating indentations or recesses 102 are again moved into align with the respective spherical member or ball 100 of the respective anvil-screen hydraulic cylinders 98. Lastly, hydraulic pressure is again supplied to the anvil-screen hydraulic cylinders 98 to maintain the anvil-screen combination 92 in its engaged in-use position.

It is to be appreciated that a variety of conventional retaining arrangement may be utilized for retaining the anvil-screen combination 92 in the in-use engaged position and, in the event that tramp metal or some other hard material is located or sandwiched between the exterior surface of the rotor 16 and inwardly facing surface of the anvil-screen combination 92, releases the anvil-screen combination 92 to avoid any damage from occurring.

Figure 16:
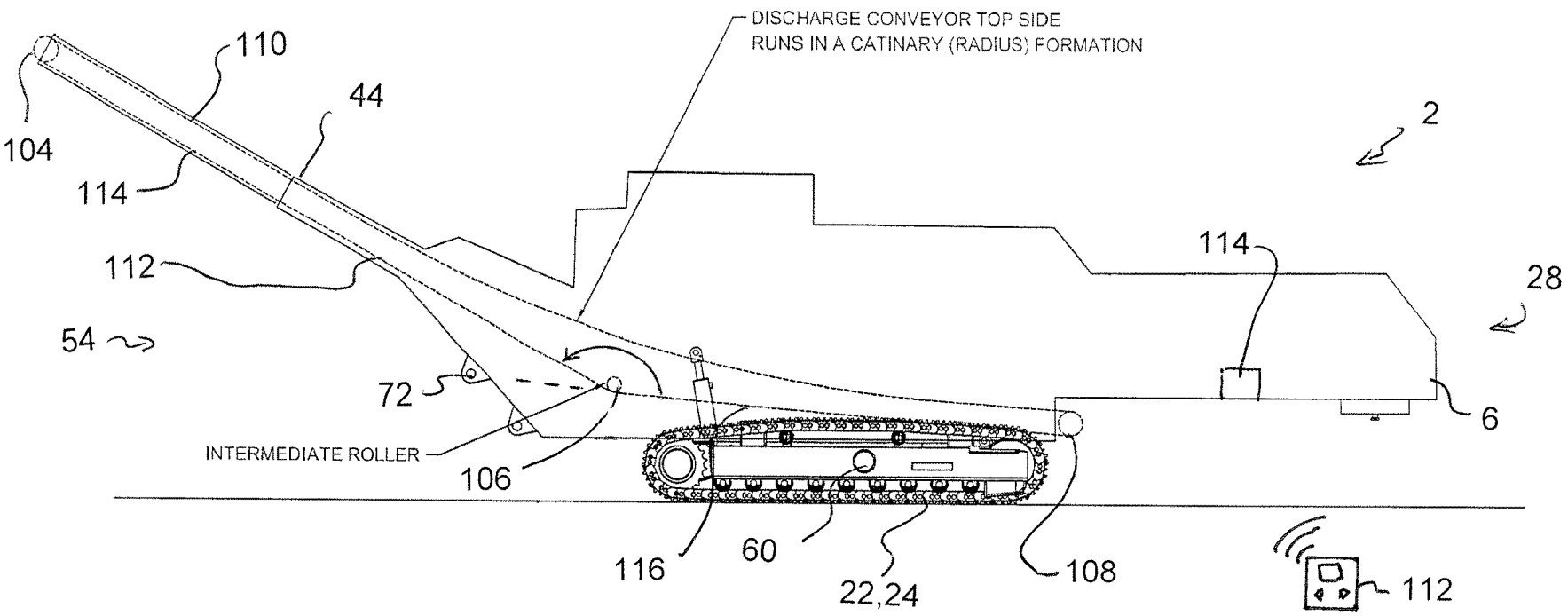
FIG. 16 is a diagrammatic right side elevational view of the portable grinding/shredding/chipping system, according to the disclosure, showing an improved discharge conveyor in which both the head and tail pulleys are driven so that the feed side of the discharge conveyer has radiussed catinary formation for discharging the comminuted material.

Turning now to FIG. 16, a further modification of the present disclosure will now be described. As this embodiment is very similar to the previously discussed embodiments, only the differences between this modification and the previous embodiments will be discussed in detail while identical elements will be given identical reference numerals.

As shown in this Figure, the discharge conveyor 44 is supported by and wraps around at least a head pulley 104, an intermediate roller 106 and a tail pulley 108. The head pulley 104 and the tail pulley 108 are both driven by a respective hydraulic motor (not shown in detail) so that both of those pulleys 104, 108 rotate in the same rotational direction and at the same rotational speed to convey the discharge conveyor 44 in an upward rotational direction for discharging the comminuted material from the portable grinding/shredding/chipping system 2 into a discharge pile, collection container, collection device, etc. This arrangement permits the head pulley 104 to pull the comminuted material, supported by the upper feed section 110 of the discharge conveyor 44, while the tail pulley 108, in turn, pushes the comminuted material, supported by the upper feed section 110 of the discharge conveyor 44, so that a catenary of the upper feed section 110 of the discharge conveyor 44 can be "tighter" than without the tail pulley 108 being separately driven. The tighter catenary of the upper feed section 110 of the discharge conveyor 44 thereby facilitates a shorter overall axial length for the discharge conveyor 44 which, in turn, generally leads to a shorter overall axial length of the portable grinding/shredding/chipping system 2. Preferably, the tail pulley 108 is typically a self-cleaning pulley which assists with self cleaning of that pulley during operation.

The upper feed section 110 of the discharge conveyor 44, during operation, typically has a relatively large radius of curvature for supporting and conveying the comminuted material. An upper first section 114 of the lower return section 112 of the discharge conveyor 44, extending between the head pulley 104 and the intermediate roller 106, forms an angle of between 135 to 175 degrees, for example, with a second section 116 of the lower return section 112, extending between the intermediate roller 106 and the tail pulley 108. Although not shown in this drawing, a bottom surface of at least one, and preferably both, of the first and second sections 114, 116 of the lower return section 112 of the discharge conveyor 44 may be supported by one or more additional return rollers.

For each of the above embodiments, it is to be appreciated that the portable grinding/shredding/chipping system 2 may be equipped with a remote radio controller 112 (only diagrammatically shown in FIG. 16) which wirelessly communicates with a control panel 114 affixed to the base frame 6 of the portable grinding/shredding/chipping system 2. The control panel 114 controls operation of the engine 12, the pump and the supply of the hydraulic pressure to the first and the second endless tracks 22, 24 in order to control forward and reverse travel, turning and/or repositioning of the portable grinding/shredding/chipping system 2, as required or desired by the operator during operation.

Since operation of tracked vehicles is conventional and well known in the art, a further detailed description concerning the same is not provided. It is to be appreciated that the radio controller 112 is generally small enough to be held in the hand of the operator so that the communicated inputted commands, from the operator, are transmitted wirelessly by the radio controller 112 to the control panel 114 which, in turn, controls operation of the portable grinding/shredding/chipping system 2 and implements the inputted commands.

While various embodiments of the present invention have been described in detail, it is apparent that various modifications and alterations of those embodiments will occur to and be readily apparent to those skilled in the art. However, it is to be expressly understood that such modifications and alterations are within the scope and spirit of the present invention, as set forth in the appended claims. Further, the invention(s) described herein is capable of other embodiments and of being practiced or of being carried out in various other related ways. In addition, it is to be understood that the phraseology and terminology used herein is for the purpose of description and should not be regarded as limiting. The use of "including," "comprising," or "having," and variations thereof herein, is meant to encompass the items listed thereafter and equivalents thereof as well as additional items while only the terms "consisting of" and "consisting only of" are to be construed in a !imitative sense.

The foregoing description of the embodiments of the present disclosure has been presented for the purposes of illustration and description. It is not intended to be exhaustive or to limit the present disclosure to the precise form disclosed. Many modifications and variations are possible in light of this disclosure. It is intended that the scope of the present disclosure be limited not by this detailed description, but rather by the claims appended hereto.

A number of implementations have been described. Nevertheless, it will be understood that various modifications may be made without departing from the scope of the disclosure. Although operations are depicted in the drawings in a particular order, this should not be understood as requiring that such operations be performed in the particular order shown or in sequential order, or that all illustrated operations be performed, to achieve desirable results.

Wherefore, I claim:

1. A portable grinding/shredding/chipping system comprising:

a base frame supporting an engine and a rotor;

the engine being coupled to the rotor for supplying rotational drive thereto;

a grinding/shredding/chipping chamber, the rotor being accommodated and rotatable within the grinding/shredding/chipping chamber, wherein the grinding/shredding/chipping chamber has an anvil-screen combination which, in a use position, is located adjacent an exterior surface of the rotor so as to facilitate comminution of the feed material, and the anvil-screen combination is pivotable away from the rotor in an event that tramp metal passes between the rotor and the anvil-screen combination so as to avoid damage to components of the portable grinding/shredding/chipping system as well as assist with servicing of the rotor;

a pair of opposed anvil-screen hydraulic cylinders axially aligned with respect to one another, wherein respective pistons of each of the respective anvil-screen hydraulic cylinders are biased toward one another by hydraulic fluid, a leading end of each one of the anvil-screen hydraulic cylinders supports a recess which supports a spherical member, while a mating side surface of each opposed side of the anvil-screen combination has a corresponding recess which is sized to matingly engage and receive the adjacent spherical member and sandwich the anvil-screen combination therebetween so as to maintain the anvil-screen combination in its engaged in-use position, located closely adjacent an exterior surface of the rotor;

a feed conveyor being supported by the base frame for feeding feed material into the grinding/shredding/chipping chamber for comminution thereof;

a feed roller cooperating with the feed conveyor to assist with feeding feed material into the grinding/shredding/chipping chamber;

a discharge conveyor, communicating with the grinding/shredding/chipping chamber, for receiving comminuted material from the portable grinding/shredding/chipping system and discharging the comminuted material from the portable grinding/shredding/chipping system; and a drive track assembly comprising a framework supporting spaced apart and independently drivable first and second tracks which facilitate movement of the portable grinding/shredding/chipping system, and the framework being connected to the base frame;

wherein a first section of the framework of the drive track assembly is coupled to the base frame by a pivotal connection which permits the framework to individually pivot relative to the base frame, and a second section of the framework and the base frame are connected to one another via spaced apart first and second hydraulic track cylinders, and the first and second hydraulic track cylinders facilitate changing an orientation of the drive track assembly, relative to the base frame, for altering the orientation of the portable grinding/shredding/chipping system relative to the drive track assembly.

2. The portable grinding/shredding/chipping system according to claim 1, wherein the pivotable connection is at or adjacent a midpoint of the framework of the drive track assembly, the first and the second hydraulic track cylinders are spaced away from the midpoint and connect the second section of the framework with a trading end of the base frame, and the second section of the framework is adjacent a trailing end of the portable grinding/shredding/chipping system.

3. The portable grinding/shredding/chipping system according to claim 1, wherein if hydraulic fluid is supplied to a first side of pistons, accommodated within the first and second hydraulic track cylinders so that a length of the first and the second hydraulic track cylinders simultaneously or separately increase, such increase in length of both of the first and the second hydraulic track cylinders causes a trailing end of the portable grinding/shredding/chipping system to pivot, about the pivotable connection, away from a supporting surface and correspondingly causes a leading end of the portable grinding/shredding/chipping system to pivot toward the supporting surface to facilitate feeding of elongate logs, trees and other elongate debris onto the feed conveyor.

4. The portable grinding/shredding/chipping system according to claim 3, wherein if the hydraulic fluid is supplied to an opposite second side of the pistons, accommodated within the first and second hydraulic track cylinders so that the length of both the first and the second hydraulic track cylinders are simultaneously or separately decrease, such decrease in the length of both of the first and the second hydraulic track cylinders causes the trailing end of the portable grinding/shredding/chipping system to pivot, about the pivotable connection, toward the supporting surface and correspondingly causes the leading end of the portable grinding/shredding/chipping system to pivot away from the supporting surface to facilitate feeding of relatively short forestry product and other relatively short debris onto the feed conveyor.

5. The portable grinding/shredding/chipping system according to claim 1, wherein the engine is coupled to the rotor by both a belt drive and a gear drive, and the belt drive and the gear drive generate a combined rotational speed reduction of a rotational output speed of the engine of between about 2.5 to 1 and 10 to 1.

6. The portable grinding/shredding/chipping system according to claim 5, wherein the belt drive comprises an engine sheave supported by the engine and an intermediate sheave supported by an intermediate shaft, and a combined rotational speed reduction of the engine can be varied, between about 2.5 to 1 and 10 to 1 to 1, by replacing at least one of the engine sheave and the intermediate sheave.

7. The portable grinding/shredding/chipping system according to claim 1, wherein the discharge conveyor is supported by and wraps around at least a head pulley, an intermediate roller and a tail pulley, and both the head pulley and the tail pulley are driven by a respective hydraulic motor so that a catenary of the discharge conveyor is radiussed.

8. The portable grinding/shredding/chipping system according to claim 1, wherein the grinding/shredding/chipping chamber comprises both a stationary housing and a pivotable housing, and comminuted material passes through openings, provided in the fixed housing, and is deposited on the discharge conveyor for discharge from the portable grinding/shredding/chipping system.

9. The portable grinding/shredding/chipping system according to claim 8, wherein the pivotable housing is pivotable away from the rotor into a stable over center position to provide access to the rotor and facilitate servicing thereof.

10. The portable grinding/shredding/chipping system according to claim 8, wherein the pivotable housing is supported by the base frame and is pivotable relative thereto about a housing pivot, and either a pair of hydraulic cylinders or a rotational cylinder couples the pivotable housing to the base frame for pivoting the pivotable housing between an in-use operative position, in which the pivotable housing seals the grinding/shredding/chipping chamber and assists with comminution of the feed material, and a service position, in which the pivotable housing is spaced away from the rotor and thereby provides access to the rotor to assist with servicing and/or maintenance thereof.

11. The portable grinding/shredding/chipping system according to claim 8, wherein the feed roller is supported by the pivotable housing and is pivotable relative thereto about a roller pivot, and a feed roller hydraulic cylinder couples the feed roller to the pivotable housing.

12. The portable grinding/shredding/chipping system according to claim 1, wherein a trailing end of the grinding/shredding/chipping system is provided with coupling features for engaging with mating coupling features of a dolly for coupling the portable grinding/shredding/chipping system to the dolly, and a kingpin is attached to an undersurface of a leading end of the portable grinding/shredding/chipping system to facilitate coupling of the leading end to a tractor for transportation of the portable grinding/shredding/chipping system.

13. The portable grinding/shredding/chipping system according to claim 1, wherein a removable kingpin assembly is removably is attached, by a disconnect mechanism, to an undersurface of a leading end of the portable grinding/shredding/chipping system to facilitate coupling of the leading end thereof to a tractor for transportation of the portable grinding/shredding/chipping system, and during operation of the portable grinding/shredding/chipping system, the removable kingpin assembly is normally disconnected from the leading end of the portable grinding/shredding/chipping system so as to not interfere with inclination of the portable grinding/shredding/chipping system.

14. The portable grinding/shredding/chipping system according to claim 1, wherein of the anvil-screen hydraulic cylinders are hydraulically connected to one another by a hydraulic line so both of the anvil-screen hydraulic cylinders are maintained at the same hydraulic pressure, and a pressure relief valve is located along the hydraulic line, in an event that hydraulic pressure in either one of the anvil-screen hydraulic cylinders exceeds a pressure limit, then hydraulic fluid is automatically released, by the pressure relief valve, thereby relieving the pressure in each one of the anvil-screen hydraulic cylinders which allows the anvil-screen combination to pivot away from the rotor.

15. A method of forming a portable grinding/shredding/chipping system the method comprising:

supporting an engine and a rotor on a base frame;

coupling the engine to the rotor for supplying rotational drive thereto;

rotatably accommodating the rotor within a grinding/shredding/chipping chamber;

locating, in a use position, an anvil-screen combination adjacent an exterior surface of the rotor so as to facilitate comminution of the feed material, wherein the anvil-screen combination is pivotable away from the rotor in an event that tramp metal passes between the rotor and the anvil-screen combination so as to avoid damage to components of the portable grinding/shredding/chipping system as well as assist with servicing of the rotor;

axially aligning a pair of opposed anvil-screen hydraulic cylinders with respect to one another, wherein respective pistons of each of the respective anvil-screen hydraulic cylinders are biased toward one another by hydraulic fluid, a leading end each one of the anvil-screen hydraulic cylinders supports a recess which supports a spherical member, while a mating side surface of each opposed side of the anvil-screen combination has a corresponding recess which is sized to matingly engage and receive the adjacent spherical member and sandwich the anvil-screen combination therebetween so as to maintain the anvil-screen combination in its engaged in-use position, located closely adjacent an exterior surface of the rotor;

supporting a feed conveyor on the base frame for feeding feed material into the grinding/shredding/chipping chamber for comminution thereof;

locating a feed roller so as to cooperate with the feed conveyor to assist with feeding feed material into the grinding/shredding/chipping chamber;

positioning a discharge conveyor for receiving comminuted material from the portable grinding/shredding/chipping system and discharging the comminuted material from the portable grinding/shredding/chipping system;

supporting spaced apart and independently drivable first and second tracks on a framework of a drive track assembly to facilitate movement of the portable grinding/shredding/chipping system;

coupling a first section of the framework of the drive track assembly to the base frame by a pivotal connection which permits the framework to pivot relative to the base frame, and connecting a second section of the framework to the base frame via spaced apart first and second hydraulic track cylinders, and the first and second hydraulic track cylinders facilitate changing an orientation of the drive track assembly, relative to the base frame, for altering the orientation of the portable grinding/shredding/chipping system relative to the drive track assembly.

* * * * *